US006416171B1

(12) United States Patent
Schmidlin

(10) Patent No.: US 6,416,171 B1
(45) Date of Patent: Jul. 9, 2002

(54) XEROJET DRY POWDER PRINTING PROCESS

(75) Inventor: Fred W. Schmidlin, Pittsford, NY (US)

(73) Assignee: Technology Innovations LLC, West Henrietta, NY (US)

( * ) Notice: Subject to any disclaimer, the term of this patent is extended or adjusted under 35 U.S.C. 154(b) by 0 days.

(21) Appl. No.: 09/188,458

(22) Filed: Nov. 9, 1998

Related U.S. Application Data

(60) Provisional application No. 60/076,461, filed on Mar. 2, 1998.

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125, 158; 399/55, 298, 293, 294, 295

(56) References Cited

U.S. PATENT DOCUMENTS 5,281,982 A * 1/1994 Mosehauer et al.
5,400,062 A * 3/1995 Salmon ..... 347/55
6,161,921 A * 12/2000 Bard et al. ..... 347/55

* cited by examiner

*Primary Examiner*—Raquel Yvette Gordon
(74) *Attorney, Agent, or Firm*—Greenwald & Basch LLP; Duane C. Basch

(57) ABSTRACT

An apparatus and method for the delivery of electrostatically charged toner particles to an image receiving member using a traveling electrostatic wave toner conveyor. The traveling electrostatic wave toner conveyor is overlaid with barrier electrodes that divide the conveyor into parallel columns, forming isolated potential wells to receive pixel packets of toner. An ejector electrode in registry with each conveyor column modulates the quantity of toner in pixel packets that travel along the parallel conveyor columns. The quantity in the packets is responsive to the modulated voltage applied to the ejector electrode. Focusing electrodes transfer pixel packets from the traveling wave conveyor as toner jets focused onto the image receiving member. A repulsive dc bias is applied to the barrier electrodes to confine toner within the conveyor columns.

Another embodiment includes an image transfer conveyor similarly overlaid with barrier electrodes. A toner supply conveyor (or four such conveyors for CMYK toners) supplies pixel packets to the transfer conveyor. An ejector electrode on the supply conveyor in registry with each conveyor column ejects toner from the supply conveyor to the transfer conveyor in response to modulated voltage. A corresponding attraction electrode on the transfer conveyor, in registry with each ejector electrode on the supply conveyor and subjected to voltage of opposite polarity, attracts toner from the supply conveyor to the transfer conveyor.

CMYK toners are of equivalent particle size small enough to reduce the granularity of continuous tone images below the threshold of visibility.

Multiplexing is accomplished by four ejector electrodes, positioned one ahead of another by one-fourth the transfer conveyor wavelength and energized together through a common bus electrode.

31 Claims, 13 Drawing Sheets

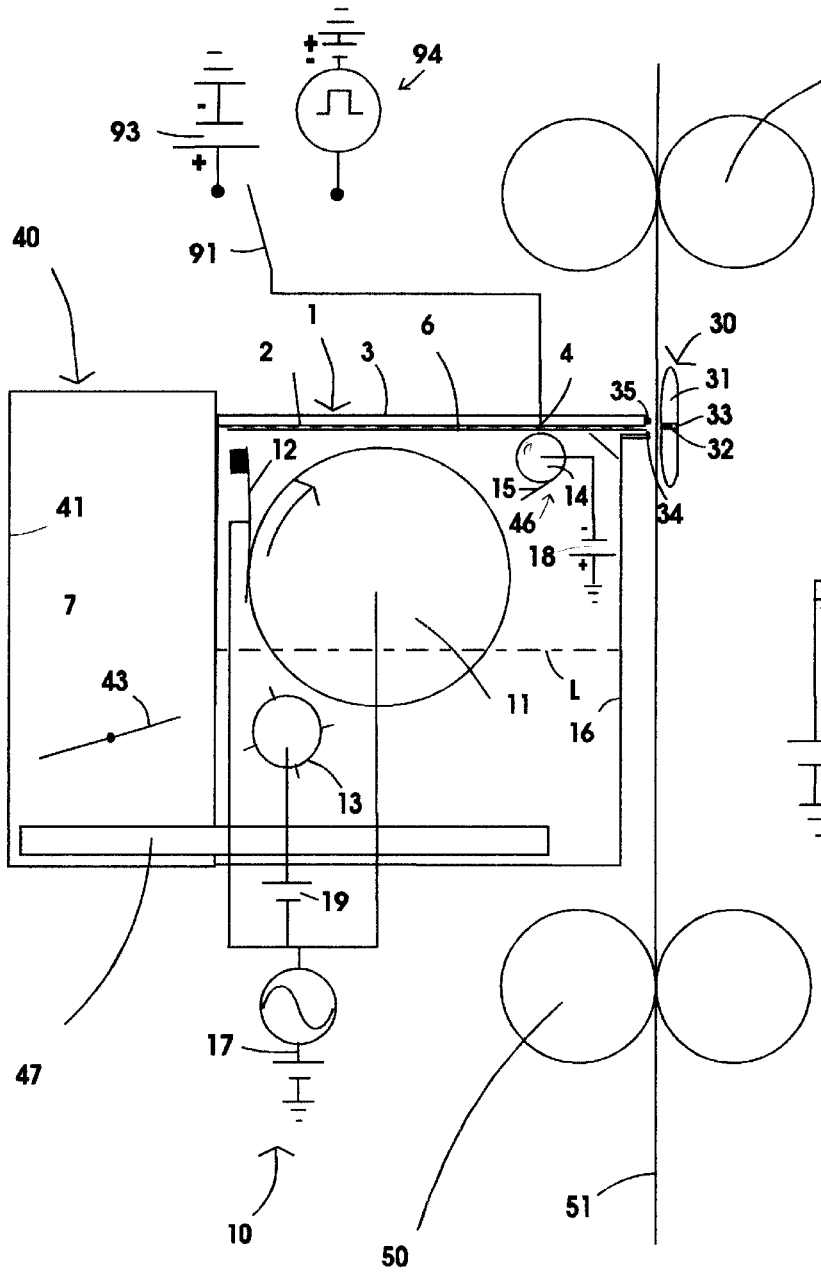
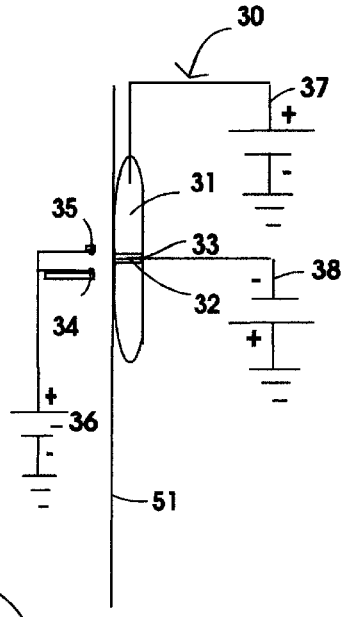
Fig. 4b
Fig. 4a

XEROJET DRY POWDER PRINTING PROCESS

CROSS-REFERENCE TO RELATED APPLICATION

Reference is hereby made to related provisional application serial No. 60/076,461 filed Mar. 2, 1998, now abandoned. The filing date of said provisional application is claimed, pursuant to 35 USC 120 and 37 CFR 1.78.

GLOSSARY OF ABBREVIATIONS AND SYMBOLS

CTC Charged Toner Conveyor $f_a$ acceleration limited frequency

TWTT Traveling Wave Toner Transport $C_a$ numerical coefficient for $f_a$

PP Pixel Packet $E_o$ electric field amplitude of traveling wave

XJ XeroJet (present invention)

$V_o$ voltage amplitude of traveling wave

DPP Digital Packet Printer (prior art)

k wave number ($=\pi/\lambda$)

DP Digital Packet $\lambda$ wavelength of traveling wave

CMYK cyan, magenta, yellow, black f frequency of traveling wave dpi dots per inch q/m tribo, or charge to mass ratio of toner v process speed of printer in cm/sec Q/wav toner charge per unit length of wave front ppm pages per minute $C_m$ numerical coefficient for Q/wav $\tau$ period of traveling wave M/wav toner mass per unit length of wave front

BACKGROUND OF THE INVENTION

Electrostatic deposition of dry powder inks (charged toner) directly onto paper, broadly identified as direct powder printing, can be classified according to whether or not the process includes the use of control apertures to modulate the quantity of toner deposited on the paper. Examples of processes that include control apertures are Direct Electrostatic Printing (DEP), invented by Schmidlin, U.S. Pat. Nos. 4,814,796, 4,755,837 and 4,876,561, and TonerJet™, invented by Larson, U.S. Pat. Nos. 5,774,159 and 5,036,341. This type of process is sensitive to wrong sign toner and requires the use of a cleaning process to clean the control apertures following every printed page. Direct powder printing processes which do not include control apertures have been disclosed by Rezanka, U.S. Pat. No. 5,148,204, Hays, U.S. Pat. No. 5,136,311, and Salmon, U.S. Pat. Nos. 5,153,617, 5,287,127 and 5,400,062.

The Salmon Patents disclose a process similar to the present invention to the extent that it utilizes a toner conveyor process. However, the toner conveyors in the Salmon Patents are very different from the Charged Toner Conveyor (CTC) (U.S. Pat. No. 4,647,179, invented by Schmidlin) in several important ways that are fully explained later on. The Salmon Patents disclose a "digital pumping" apparatus for moving discrete packets of toner, called "Digital Packets" (DPs), along an array of column conveyors from a toner source at one end of the column conveyors to a receiver sheet at the other end of the column conveyors. One column conveyor is used for each pixel site to be printed across the width of a page. Each column conveyor is an independently controlled linear array of narrow electrodes, optimally five microns wide, to accommodate single rows of toner that extend the length of the electrodes. Such rows of toner are called Digital Packets (DPs). One DP consists of two to five toner particles depending on the toner size. Discrete levels of gray are printed at each pixel site on the receiver sheet by counting out the number of DPs to be deposited on that site. For example, for a 600 dpi resolution printer, 16 DPs are deposited at a single pixel site to print black, or a saturated reflection density. White or gray pixels are then formed with 0 to 15 DPs.

Transport, or "digital pumping", of DPs in the Salmon method is achieved with three-phase digital pulses. An end view of a trapezoidal potential well is illustrated in FIG. 1. This figure depicts a moment in time when the digital voltage level of phase b is low and the voltage level of phases a and c are high. This produces a trapezoidal potential well whose spatial depth is effectively comparable to the combined width of one electrode and space. The size of the electrodes are claimed by Salmon to be optimally 5 microns so that the trapezoidal well will hold a single toner particle in the process direction (left to right in FIG. 1). The ordinate in FIG. 1 represents both voltage and distance above the conveyor surface, with their scales chosen to illustrate the effective depth of the potential well in relation to the size of the toner. The end view of a single DP is shown in FIG. 1 to illustrate this important sizing feature. "Digital Pumping" moves a DP along the conveyor by cycling the low phase through the sequence b, c, a, b etc., with proper timing (c lowered slightly in advance of raising b, etc.). In this manner the trapezoidal potential well is stepped along the conveyor, carrying the DP with it. Because the potential wells are small (comparable to the size of a toner particle), the toner must move in sliding or rolling contact with the conveyor surface. Otherwise, any perturbing influence during the digital stepping process will cause a trapezoidal potential well to lose control of toner particles in a DP.

It is appropriate to recall here that movement of charged toner particles in sliding/rolling contact with a stationary solid boundary was an objective of my original CTC invention. Early experiments with CTCs, however, revealed that sliding or rolling contact of toner particles with the conveyor surface could not be achieved (cf., Fred Schmidlin, "A New Nonlevitated Mode of Traveling Wave Toner Transport", IEEE Transactions on Industry Applications, Vol. 27, No. 3, May/June 1991). Instead, the toner particles were discovered to move in an aerosol state as tiny linear clouds, with one such cloud confined in the potential trough of each wave. This mode of Traveling Wave Toner Transport (TWTT), illustrated in FIG. 2, was called the "Surfing Mode" because toner particles are pushed by a traveling electrostatic sine wave in much the same way a surf rider is pushed by a water wave. The wavelength of the traveling wave required for this mode of transport must be at least six to eight times the particle diameter. Each particle needs room on the stable part of a wave (the concave upward portion of the wave following the wave minimum) to recover its equilibrium position on a wave after being scattered by the conveyor surface or other mutually repulsive toner.

Because toner scattering is difficult to avoid on a conveyor at particle speeds of practical interest for printing applications (greater than one meter per second), it is predicted that practical implementation of the Salmon invention, called Digital Packet Printing (DPP), is not feasible or severely limited. Although DPs can be moved with toner-sized, digitally-driven "square wells" at slow speeds (as demonstrated with miniature models by Salmon), the reliability required for quality printing at practical transport speeds has not been demonstrated and is claimed to be unreliable or impractical.

Another problem with DPP, as described in the aforementioned Salmon Patents, is that the mutual repulsion of same polarity toner will also cause particles to hop uncontrollably between contiguous channel conveyors. Salmon has recently addressed this problem by incorporating barrier electrodes, or "guide rails", between adjacent conveyor channels. But this feature does not prevent toner particles from skipping or slipping between DPs in the process (or propagation) direction.

Another problem with DPP is the inclusion of "packet step" and "packet hold" processes wherein toner movement is stopped for periods of time. During this time, toner adhesion to the conveyor surface tends to grow with time, making it difficult to start the toner moving again. Indeed, experience has shown that toner inertia plays an important role in TWTT and collisions with other moving toner particles are generally required to get toner stalled on a conveyor moving again. Therefore, "packet hold" processes are undesirable and should be avoided.

Another problem with DPP is its complexity. The proposed DPP architectures include multiple toner conveyors and "writing heads". Accurate registration and alignment of the writing heads is required for page width printing applications.

Another problem, or undesirable limitation, of DPP is its ability to print discrete density levels only. Forty-eight clock steps, or 16 "waves", are required to print one of 16 density levels (including white), at one pixel site. Therefore, the usual half-toning process commonly used in the printing industry must be used to print more than 16 levels of gray. Customary procedures, such as dot-dithering, must then be used to mask unwanted image defects, such as contouring—a problem that is most noticeable in the highlight areas of an image.

Another limitation of DPP is that the new method of multiplexing disclosed herein would be significantly limited if it were applied to the digital pumping process on which DPP is based.

Finally, another limitation of DPP is its process speed. As shown in my aforementioned IEEE paper, toner dynamics (inertia) limits the operating frequency and mass flow rate of traveling wave transport. The same physical constraints must limit the digital pumping process at least as severely. This is borne out in the analysis provided below.

The present invention, called "XeroJet" (XJ), overcomes the above problems and limitations of DPP. It is a dry powder printing process in which toner flow on a CTC is divided into parallel columns that feed an array of toner jets formed at the downstream end of the CTC. Quite apart from the details of this invention, however, its ability to overcome the limitations of DPP is predicted from well-established properties of the surfing mode of TWTT on which this invention is primarily based. This important mode of toner transport is schematically illustrated in FIG. 2. It shows the size and aerosol character of the toner in relation to the traveling sine wave that drives the surfing mode of TWTT. Note that the wavelength of the traveling sine wave is much larger than the size of the toner particles (at least six times the toner diameter) and the number of toner particles transported per unit length of wave front is much greater than the number transported via DPP. This basic feature is vital to the high toner flow rates achieved with TWTT. Indeed, recent experiments with 500 microns wavelength CTCs have demonstrated toner flow rates in excess of 25 mg/cm-sec. This is adequate to cover a receiver sheet placed at the downstream end of a CTC with one mg/cm$^2$ of toner (enough to produce a saturated reflection density) at the speed of 25 cm/sec, or 60 pages per minute.

To provide a broad basis for the design and projected performance of CTCs for the present invention, a summary of the relevant background analysis now follows.

Toner flow on a conventional CTC is controlled by two factors. The first is the acceleration limited drive frequency, denoted by $f_a$. As derived in the above IEEE paper, $f_a=C_a$ sqrt($E_o$kq/m) where q/m is the average charge to mass ratio of the toner (also known as "tribo" in the xerographic industry), $E_o$ is the electric field amplitude of the wave, k is the wave number ($2\pi/\lambda$), $\lambda$ is the wave length of the traveling wave and $C_a$ is a numerical coefficient. $C_a$ is approximately equal to 27 when $E_o$, k and q/m are expressed in standard mks units. $E_o=kV_o$, where $V_o$ is the voltage amplitude of the wave. At wave frequencies greater than $f_a$ toner particles starting from rest cannot catch a wave. The inertial force that limits $f_a$ also restores scattered particles to their equilibrium position on a wave. Therefore, the possibility of transporting toner at higher frequencies by starting the particles with an initial velocity is unlikely. The second factor controlling toner flow on a CTC is the maximum charge per unit length of wave front (Q/wav) transportable by one wave. Based on space charge limitations, this is estimated to be Q/wav=$C_m$ 885$E_o$/k. Here the numerical coefficient $C_m$ depends on how closely the toner particles come into proximity with the conveyor surface, or the degree by which the space charge of the toner neutralizes the electric field of the traveling wave. $C_m$ is estimated to be between ½ and 2, when $E_o$ and k are in volts/micron and cm$^{-1}$ respectively, giving Q/wav in pico-Coulombs per cm (pC/cm). The maximum mass per unit length of wave front that can be transported by one wave is then given by M/wav=Q/wav/(q/m). The practical unit of M/wav is $\mu$g/cm when Q/wav and q/m are expressed in the practical units of pC/cm and $\mu$C/gm respectively. The maximum toner mass flow on a conveyor per unit distance along a wave front is then given by dm/dt=$f_a$M/wav. The unit is mg/(cm-sec). If the toner flows onto a receiver sheet placed at the end of the conveyor, the speed of the receiver sheet will determine the collected mass per unit area. Assuming one mg/cm$^2$ toner on a receiver sheet produces saturated reflection density, the speed of the sheet (v), in cm/sec, becomes numerically equal to the toner mass flow on the conveyor (dm/dt) in mg/(cm-sec). Toner mass flow on a conveyor (in mg/cm-sec) therefore predicts the process speed v anticipated for printer applications.

To illustrate the potential printer speeds inferred from the above analysis, graphs of the estimated process speed (v) and acceleration limited drive frequency, $f_a$, vs. conveyor-wavelength are shown in FIGS. 3*a* and 3*b*. The curves in FIG. 3*a* are constructed to agree with recent experimental data at 500 microns wavelength. The experiments were performed using the values of q/m and $E_o$ shown in the figure. The value of $f_a$ at 500 microns, using the theoretical coefficient $C_a$=27 (see IEEE paper), proved to match the frequency that provided the maximum toner mass flow in the experiments. Matching the magnitude of the maximum mass flow, to its analytical expression above yields $C_m$=0.47. To illustrate the impact of changing the control parameters ($E_o$, q/m and $C_m$), the curves in FIG. 3*b* are constructed with the values of theses control parameters chosen near their estimated practical upper bounds. $C_m$=1.3 corresponds to the maximum packing of toner in a potential well 30 microns wavelength based on their physical size, independent of their charge.

Further insight on the dependence of process speed on the physical quantities $E_o$, q/m and $\lambda$ can be gleaned from the overall scaling law $v \sim E_o^{3/2}(q/m)^{-1/2}\lambda^{1/2}$. The $\lambda^{1/2}$ dependence obtained here is reflected, of course, in FIGS. 3*a* and 3*b*. It is now evident that a large field amplitude of the traveling wave ($E_o$) and low tribo (q/m) are also important factors contributing toward high process speed. The maximum possible value of $E_o$ is limited by the onset of corona or electrical breakdown. With normally insulated conveyor electrodes, $E_o$ may be as high as 9 V/$\mu$ for wavelengths below 500 microns. An unlimited small value of q/m, though appearing attractive here, is not possible. Further studies are needed to establish the lower limit of q/m. But the experimental data used for FIG. 3*a* shows that the tribo can be at least as low as 3 $\mu$C/gm.

To finally predict the process speeds attainable with the printer method disclosed herein, it is sufficient to identify the potential working range of conveyor wavelengths that can be utilized. A shortest working wavelength emerges from the requirement that toner particles must have free volume to move as an aerosol—not in rolling/sliding contact with the conveyor surface. The volume of a traveling potential well per unit length along the wave front is proportional to $\lambda^2$, considering that both its depth and extension in the propagation direction are proportional to $\lambda$. But due to the space charge limitation assumed earlier, the number of toner particles that can be put in this same volume grows linearly with $\lambda$. Further considering that the toner particles are forced into contact with each other and the conveyor surface at $\lambda$=30 microns (also forcing a sliding or rolling action), it follows that the free volume per particle available for perturbed particle movement (displacements from equilibrium) must grow in proportion to $\lambda$–30. This suggests a reasonable lower bound for $\lambda$ of roughly 50 microns. This will provide adequate free space for toner particles to nudge each other or be scattered without being knocked out of the potential well transporting them.

An upper bound for $\lambda$ emerges from the image resolution desired for a specific printer application. A representative resolution requirement is 600 dpi, implying a maximum pixel size of 42 microns on a side. For TWTT, there is an inherent pixel size feature only for the process direction. This is the length of the receiver sheet covered by toner delivered by one wave, given by $v\tau$, v is the speed of the receiver sheet (or process speed) and $\tau$(=1/f) is the period of the wave. The pixel size in the cross direction is established by segmenting the linear toner clouds by means disclosed in detail later herein. For this reason, the number of 10 microns diameter toner particles contained in a 42 microns long segment of a linear toner cloud, denoted #/pix, is included in FIGS. 3*a* and 3*b*. I call this a "pixel packet", and when it equals 35 (for 10 microns diameter particles) it will cover a 42 microns square pixel on the receiver sheet. For the conditions considered for FIGS. 3*a*, it is easily identified that the corresponding conveyor wavelength is 300 microns. For the conditions in FIG. 3*b*, the corresponding wavelength is 500 microns. The resolution in both cases is 600×600 dpi. Of course, any shorter wavelength would enable the same resolution but with a sacrifice of process speed. The pixel size at any other wavelength is proportional to #/pix. Considering further that possible constraints may arise from segmenting the linear toner clouds, it is estimated that the preferred wavelength range of CTCs for the present invention is 100 to 300 microns.

To facilitate comparison of the process speeds predicted above with those estimated for DPP, the graphs in FIGS. 3*a* and 3*b* are extended down to 30 microns wavelength. Although this wavelength is below the lower bound identified for TWTT, it is the wavelength considered optimal for DPP. For the conditions in FIG. 3*a*, the predicted speed for TWTT at $\lambda$ 30 microns would be 7 cm/sec if it were operative here. The speed estimated for DPP, on the other hand, is 4 cm/sec, assuming the accelerated limited frequency is applicable and the same toner can be used in both cases. This result is indicated by the label "2" in FIG. 3*a*. But, as shown above, the same resolution (600 dpi) with TWTT can be achieved at a wavelength of 300 microns, potentially enabling the speed to increase to 21 cm/sec—a better than 5 to 1 speed advantage over DPP. Similarly, for the conditions in FIG. 3*b*, the speed for TWTT at 30 microns wavelength would be 13 cm/sec if it were again operative here. Interestingly, the #/pix proves to be just 2 particles in this case, implying a speed of 13 cm/sec for DPP as well. But in this case the wavelength for TWTT could be as high as 500 microns, implying a potential process speed of 53 cm/sec—a 4 to 1 speed advantage over DPP. It is thus concluded that printers based on TWTT will provide a significant speed advantage over DPP.

Another well-stablished property of the surfing mode of TWTT (see my IEEE paper) that shall be exploited in the present invention is that traveling toner clouds extend less than ¼ of a wavelength in the direction of propagation. This is key toga novel method of multiplexing that is disclosed below.

SUMMARY OF THE PRESENT INVENTION

This invention relates to electrostatic printing systems and more particularly to direct powder printing processes based on the proven surfing mode of TWTT. The toner flow on a CTC is divided into an array of parallel pixel wide columns by overlaying the CTC with an array of barrier electrodes or "guide rails" separated by the pixel size for a desired resolution (e.g., 42 microns for 600 dpi resolution). At the downstream end of the CTC, the toner flowing down each column is formed into a toner jet that is focused onto an image receiver sheet. The barrier electrodes further divide the linear toner clouds transported by each traveling wave into pixel sized segments, called "Pixel Packets" (PPs). The set of PPs derived from one segmented toner cloud finally forms one complete row of pixels in a line across an image receiver. A modulating ejector electrode is also inserted in each pixel wide column of the CTC to continuously modulate the quantity of toner in a PP. This important feature enables the printing of continuous-tone images. Since the process forms dry toner jets during transfer from the conveyor to receiver, I call this new printing process "XeroJet". This highlights its important dry ink feature while being similar in character to liquid ink-jets. XJ is also a continuous-flow analog process in contrast to DPP which is a digital process designed to print a limited number (16) of discrete density levels with a counted number of DPs.

The present invention also includes a novel means of multiplexing which is enabled by the fact that toner clouds on CTCs are spatially confined in the direction of transport to a small fraction (typically ⅙ to ⅛) of a wavelength. This makes it possible to modulate a group of PPs in contiguous columns on, the conveyor at different times (or phases) of a wave period using a common modulating electrode. This feature is important because it results in significant structural simplicity and cost reduction with no sacrifice in process speed.

XJ provides numerous advantages over prior art in direct printing. It is capable of printing continuous-tone color images at high speeds. It should not require frequent cleaning. In contrast with DPP, it is based on a proven toner transport technology and provides a simpler, continuous flow process that utilizes a simpler, low-cost architecture. Its potential process speed is also significantly greater.

This invention provides the opportunity to make printers emulating dye-diffusion quality, at the low cost of liquid ink-jet printers, and at the speed of laser printers. Important embodiments include low-cost, continuous-tone color printers capable of printing color photographs.

DRAWINGS

Figure 1:
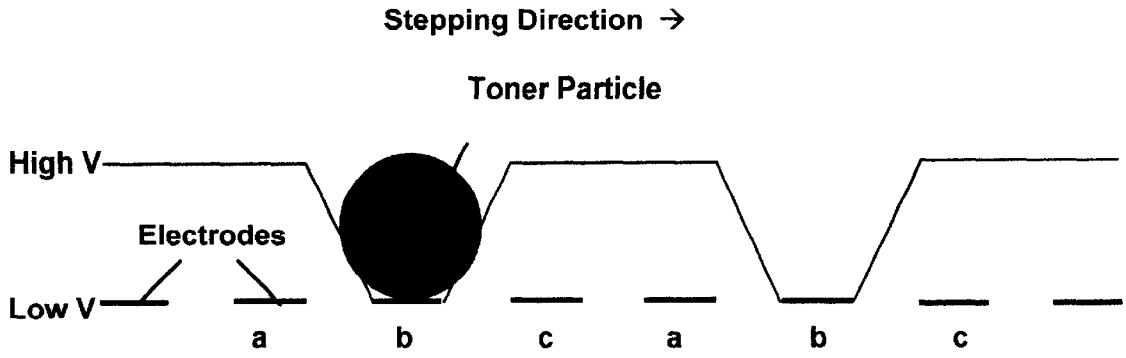
Prior Art Fig. 1
FIG. 1 is an end view schematic of a DP in a trapezoidal potential well of a "digital pumping" conveyor in the prior art of DPP.
Figure 2:
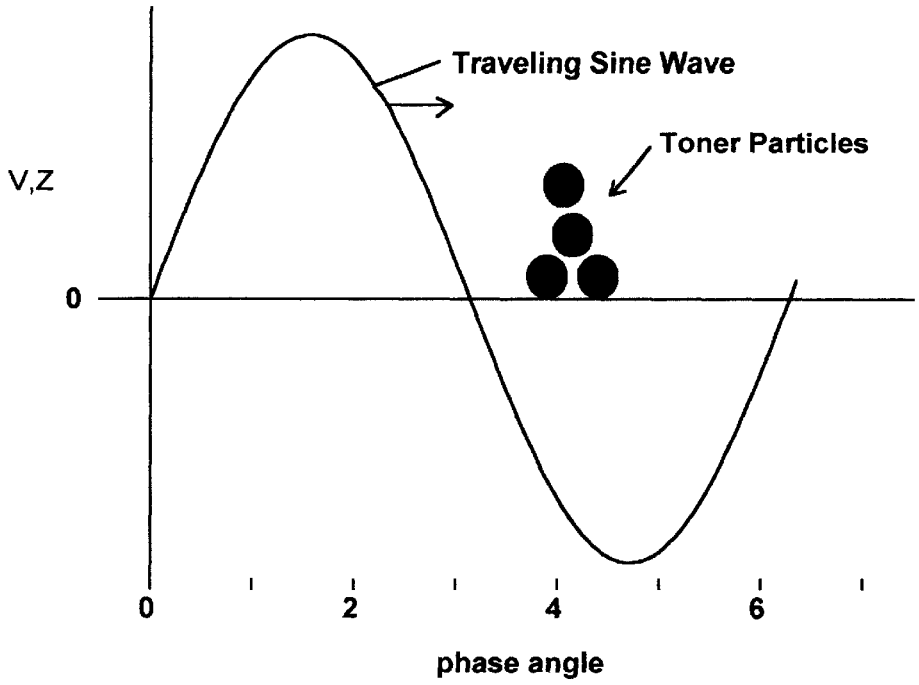
FIG. 2 is a schematic of a traveling sine wave pushing a toner cloud in the surfing mode in accordance with established TWTT technology.
Figure 3A:
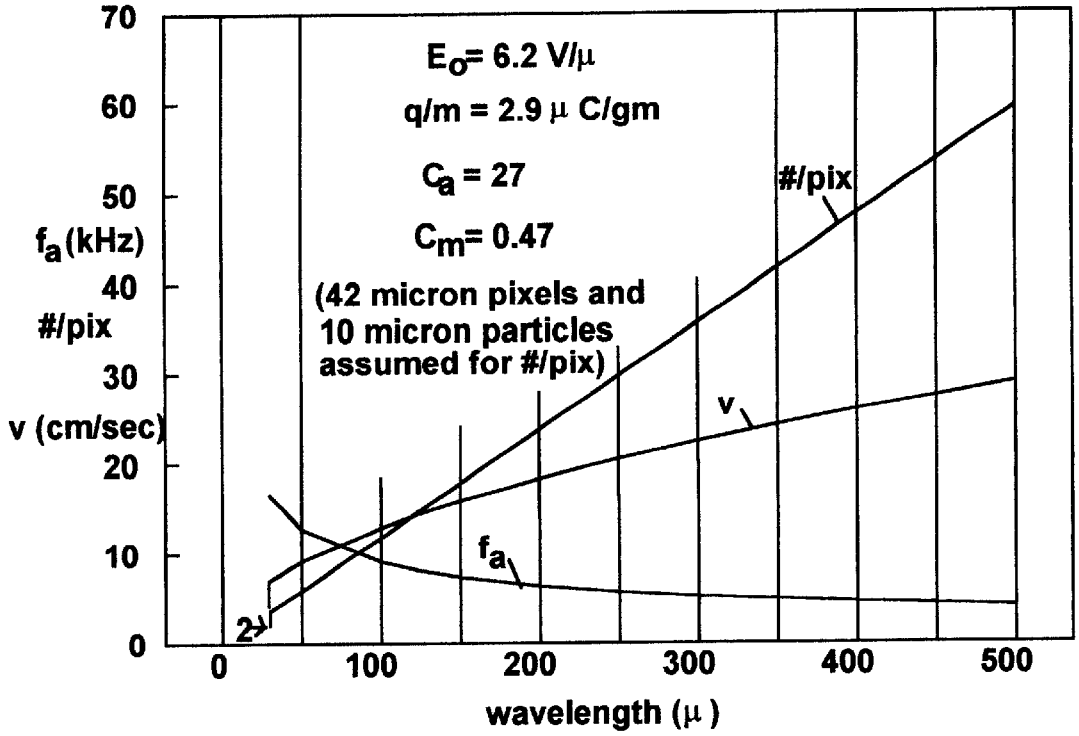

FIG. 3*a* is a graph of theoretically predicted properties of TWTT for CTCs of different wavelength. Acceleration limited frequency ($f_a$), potential print speed (v) and number of toner per pixel packet (#/pix) for TWTT are plotted vs. conveyor wavelength, with coefficients $C_a$ and $C_m$ determined by fitting the graphs to experimental data at the wavelength of 500 microns ($\mu$).

Figure 3B:
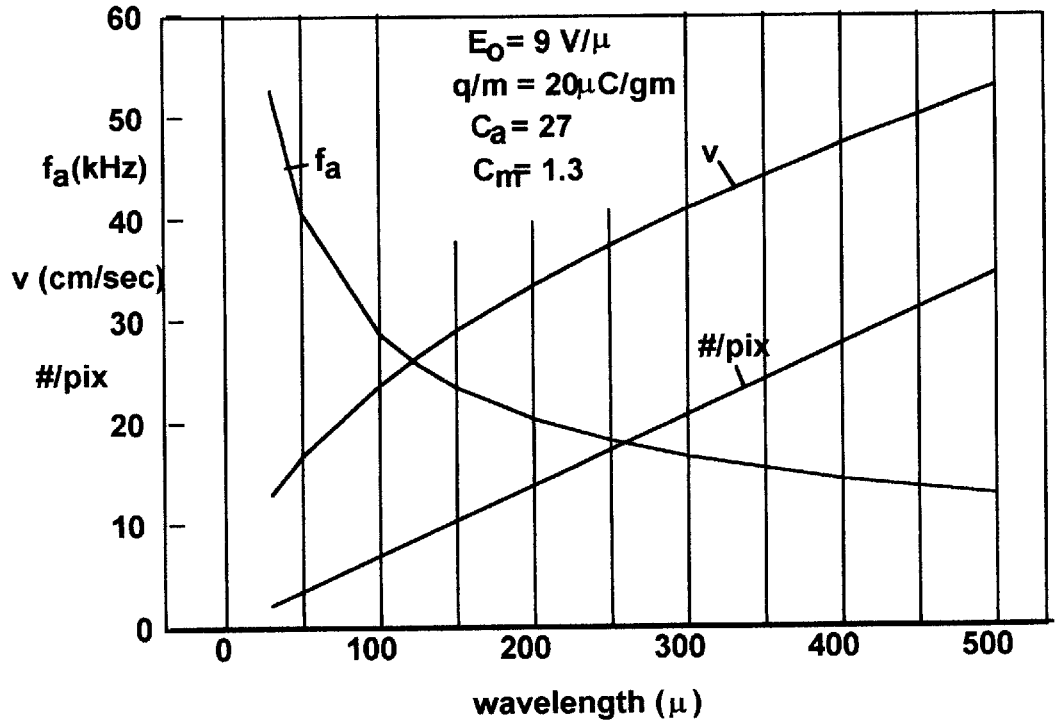

FIG. 3*b* is a graph of the same quantities in FIG. 3*a* with values of the control parameters ($E_o$, q/m, $C_a$, $C_m$) selected near their natural upper bounds.

FIG. 4*a* is a schematic side view of a subtractive monochrome XJ print engine according to this invention.

FIG. 4*b* is an enlarged detail of FIG. 4*a*.

Figure 4C:
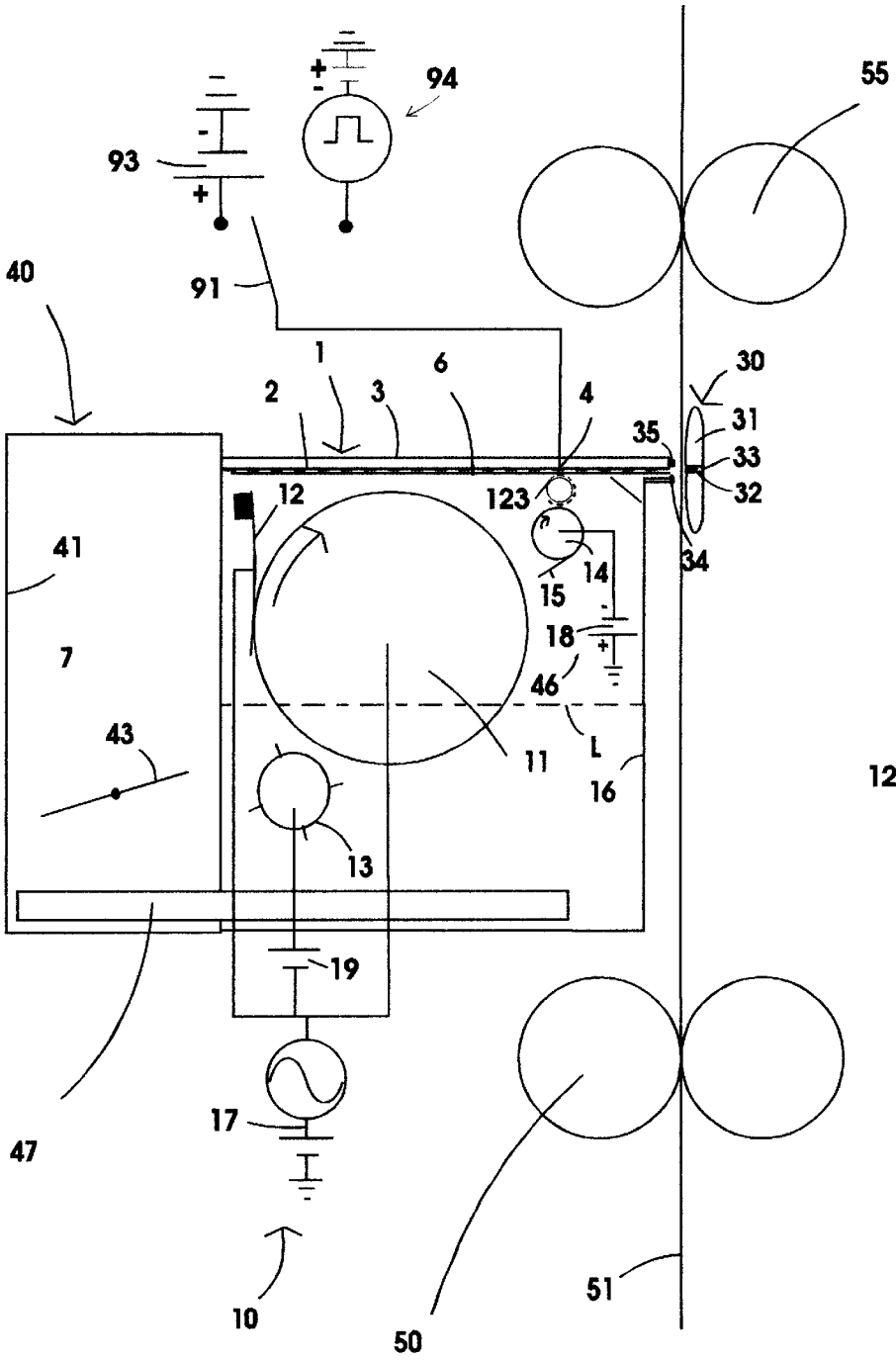

FIG. 4*c* is a schematic side view of the XJ print engine of FIG. 4*a,* including a traveling wave receiver conveyor.

Figure 4D:
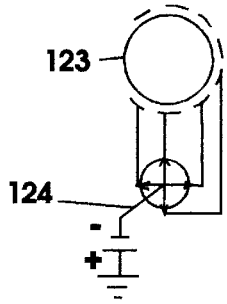

FIG. 4*d* is an enlarged detail of FIG. 4*c*.

Figure 5:
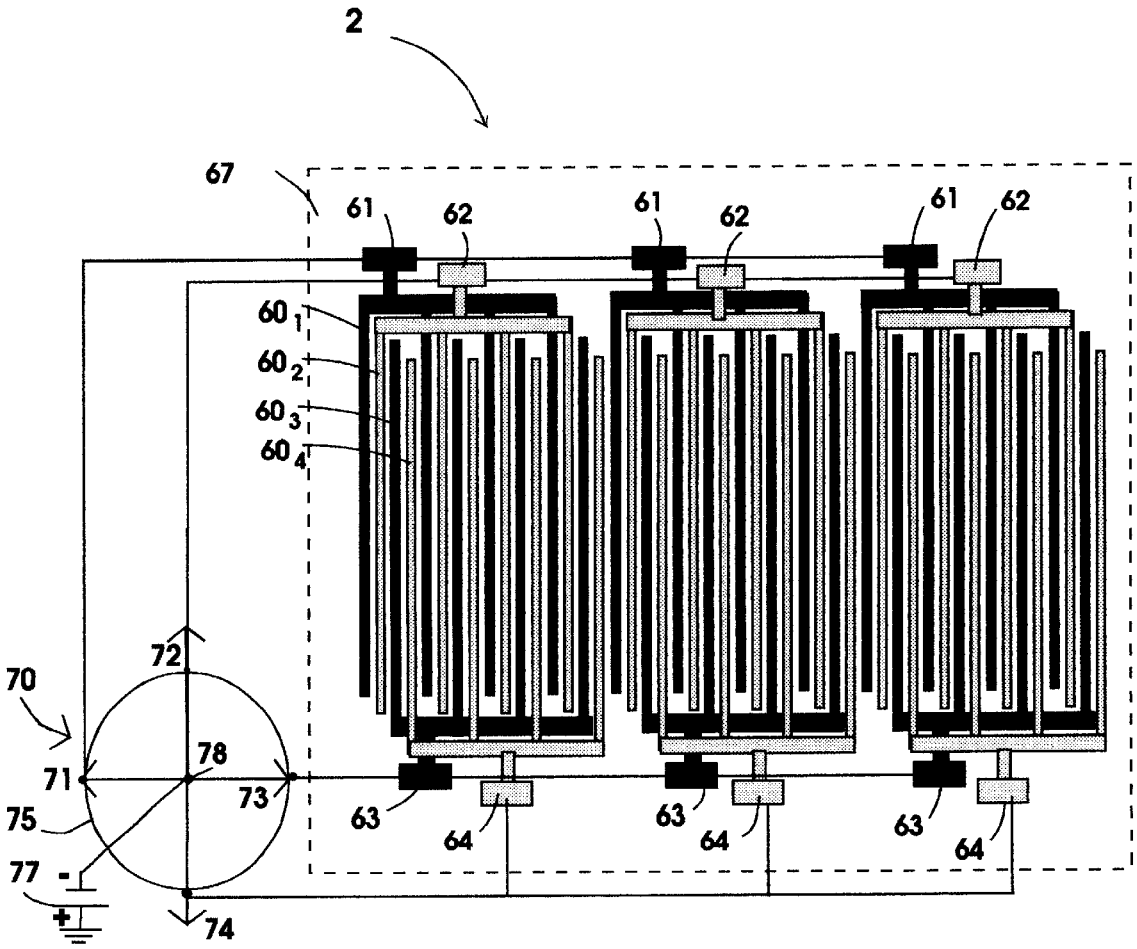

FIG. 5 is a schematic plan view of a four-phase CTC connected to a four-phase sine wave generator.

Figure 6:
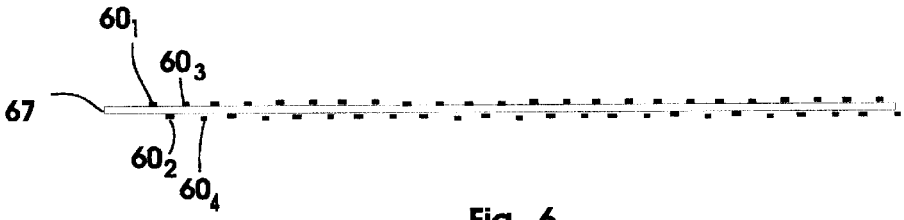

FIG. 6 is a schematic edge view of the CTC as seen from the bottom of FIG. 5.

Figure 7:
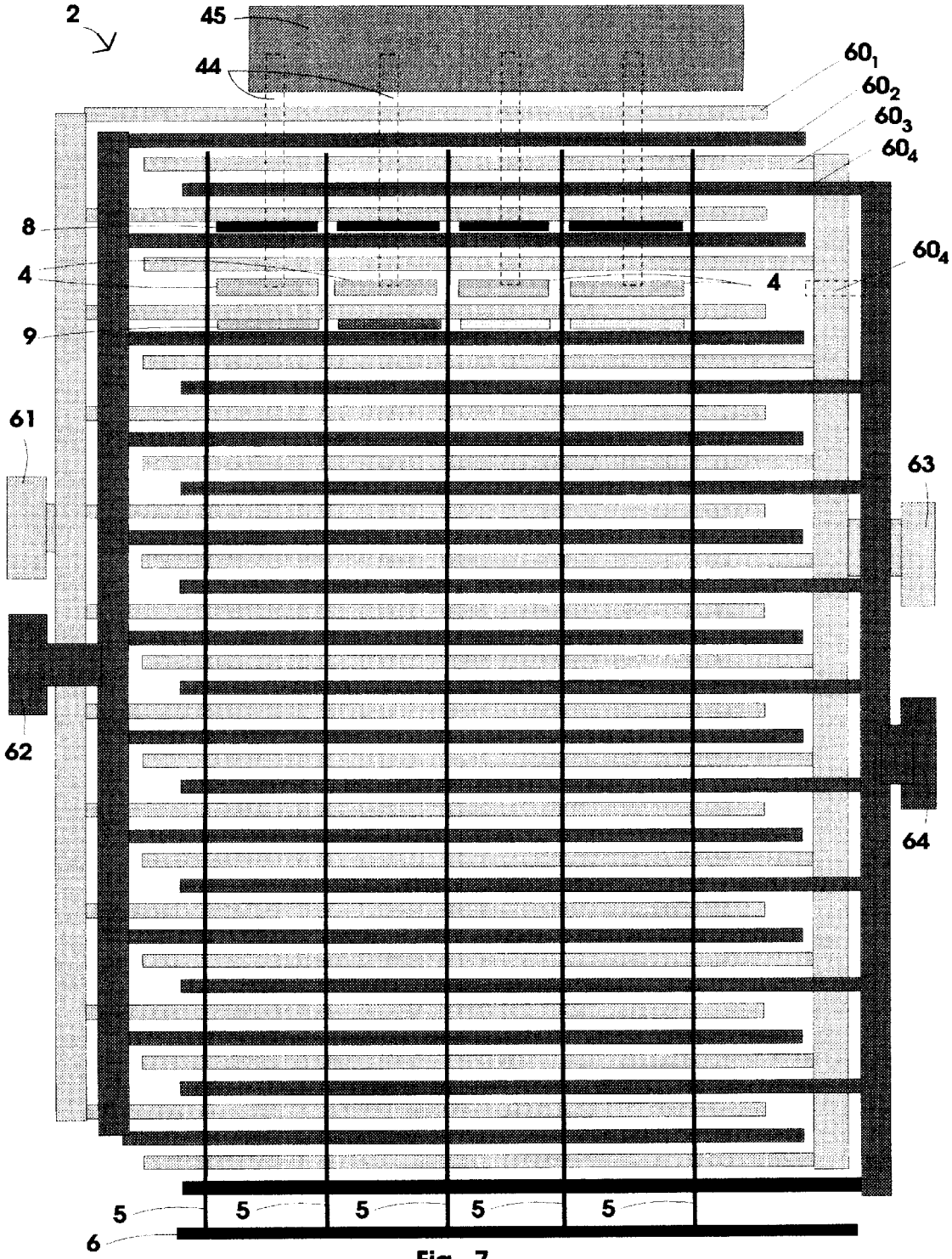

FIG. 7 is a schematic plan view of an XJ printhead including an overlay of barrier electrodes on a CTC and modulating ejector electrodes. (The underlying CTC in FIG. 7 is similar to that in FIG. 5, rotated 90° counterclockwise.)

Figure 8:
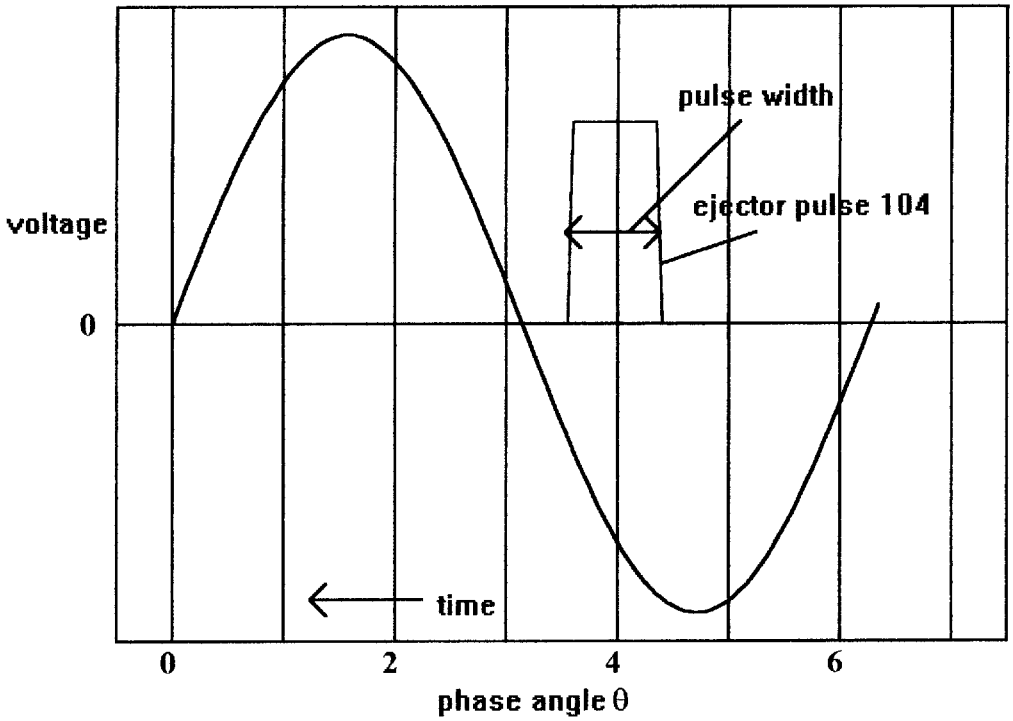

FIG. 8 is a graphic plot of the timing of an ejector pulse in relation to the phase of a traveling wave.

Figure 9:
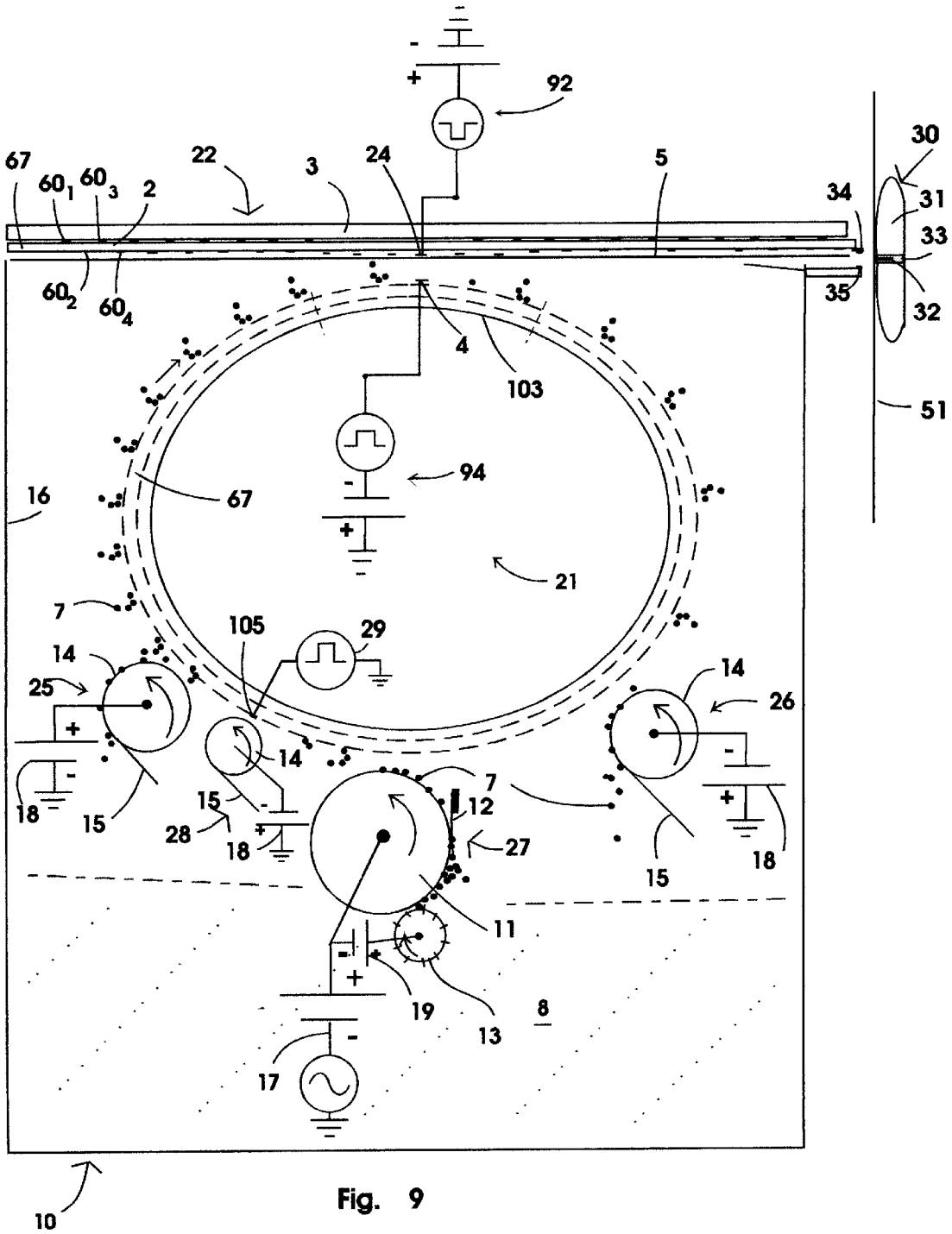

FIG. 9 is a schematic side view of an additive monochrome XJ print engine according to this invention.

Figure 10A:
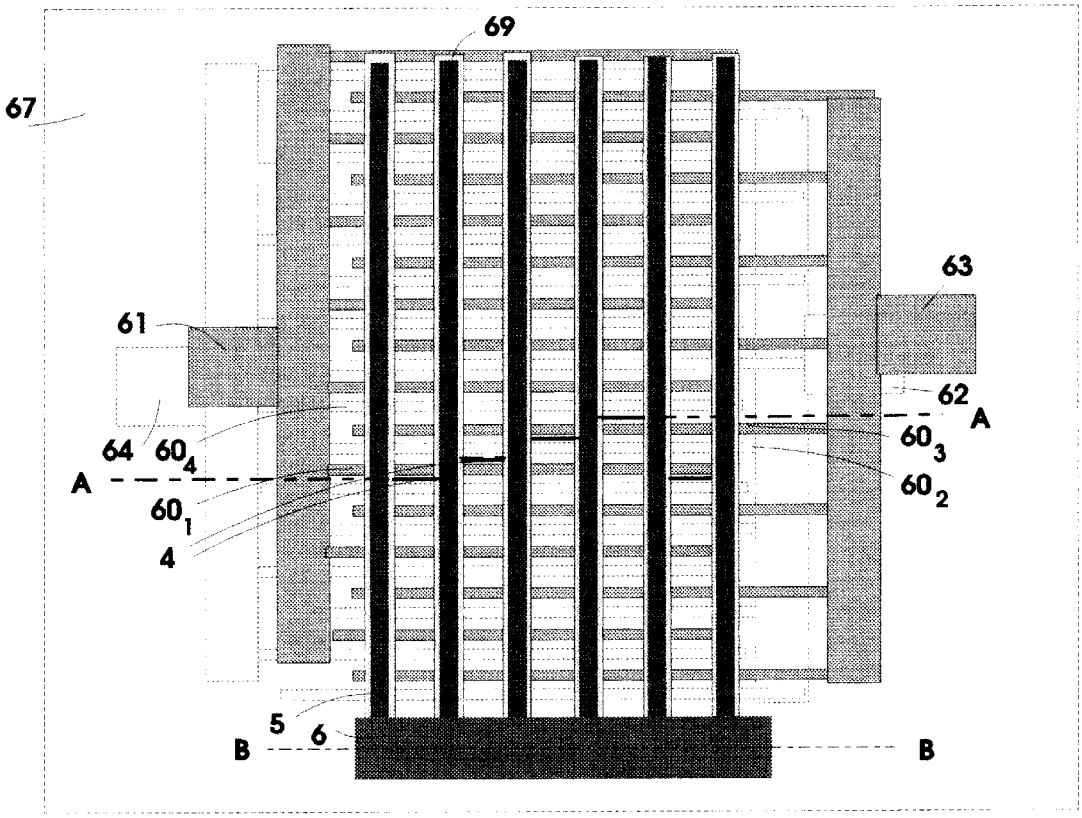

FIG. 10*a* is a schematic plan view of a printhead showing an ejector electrode arrangement suitable for 4× multiplexing with ejector electrodes inserted between conveyor electrodes.

Figure 10B:
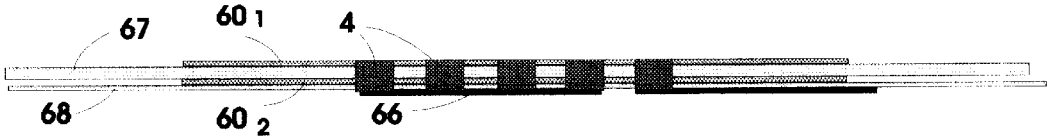

FIG. 10*b* is a schematic edge view through Section A—A of FIG. 10*a*.

Figure 10C:
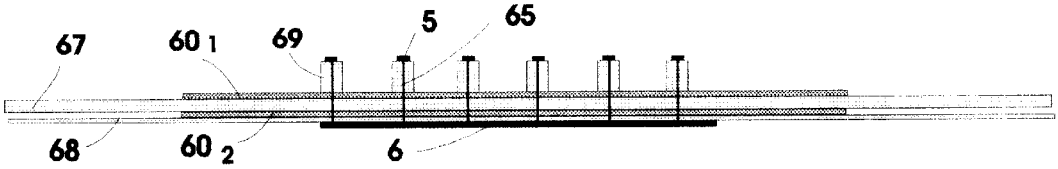

FIG. 10*c* is a schematic edge view through Section B—B of FIG. 10*a*.

Figure 10D:
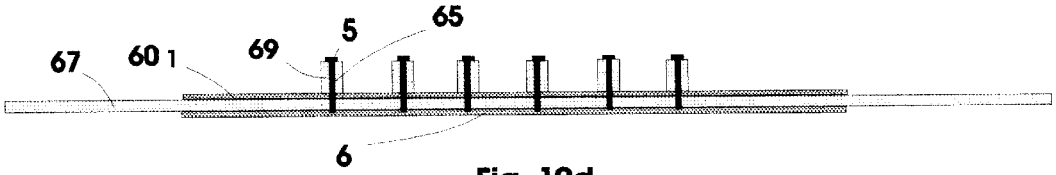

FIG. 10*d* shows an alternative form of the structure shown in FIG. 10*c*.

Figure 11A:
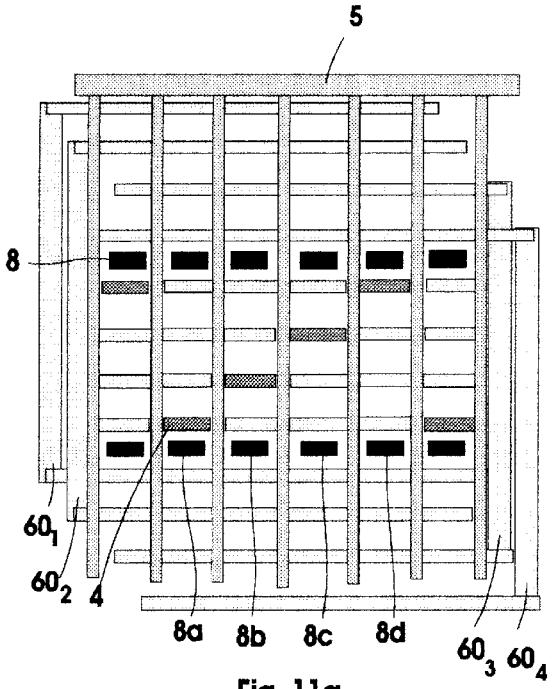

FIGS. 11*a,* 11*b,* 11*c,* 11*d* are schematic plan views or successive "snapshots" of modulated pixel packets on an XJ printhead in the 4×multiplexing mode.

Figure 12:
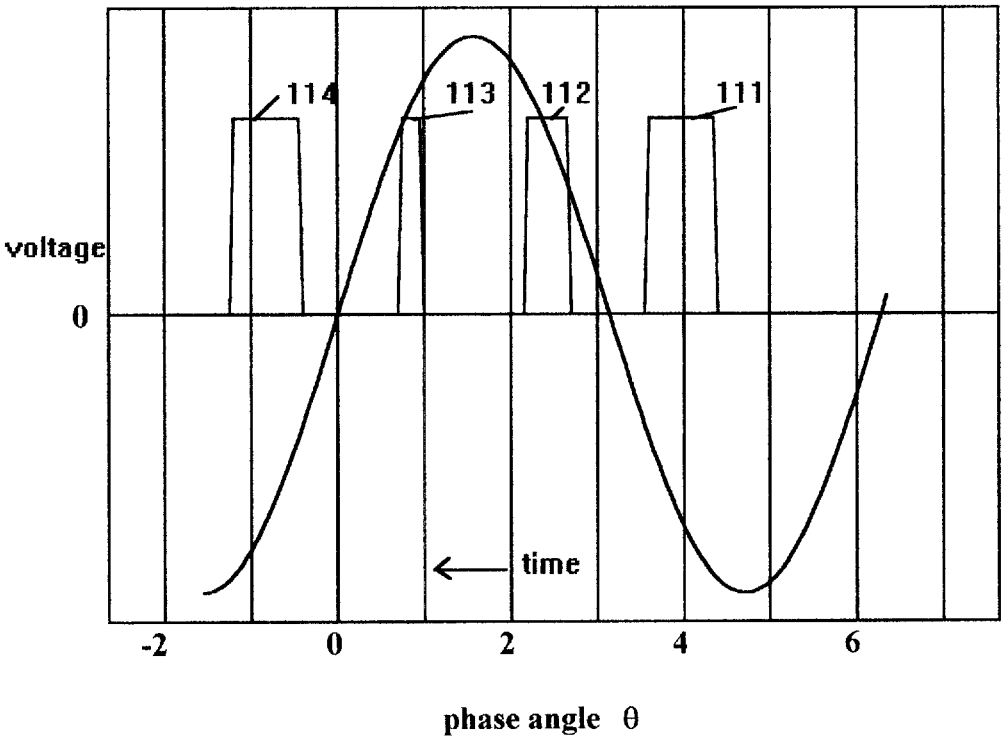

FIG. 12 is a graphic plot of the timing of a driver pulse in relation to the conveyor wave for the multiplexing mode.

Figure 13:
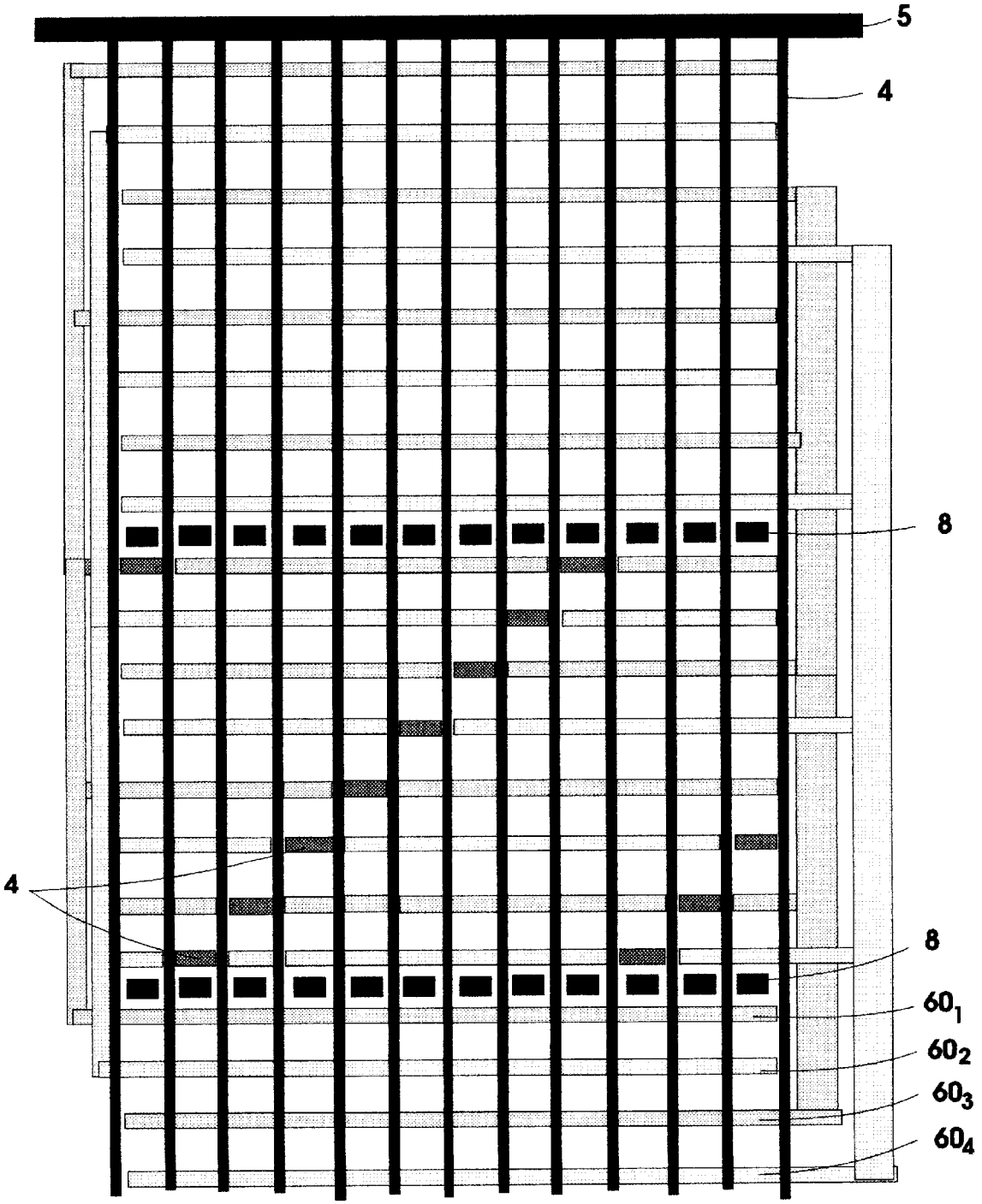

FIG. 13 is a schematic plan view of an XJ printhead in the 8×-multiplexing mode.

Figure 14:
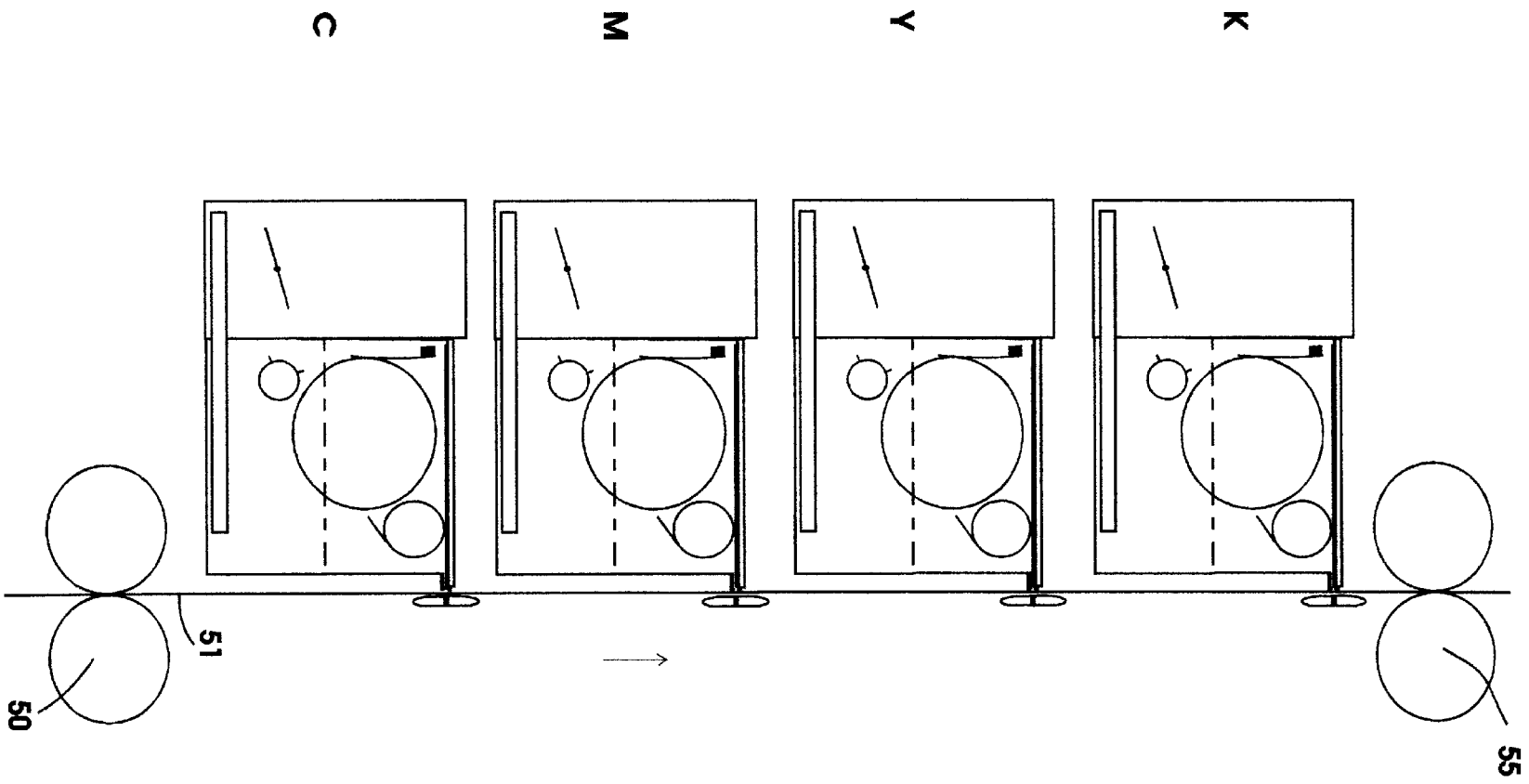

FIG. 14 is a schematic side view of a full color process including four XJ monochrome engines in tandem printing CMYK toners in sequence on a common receiver sheet.

Figure 15:
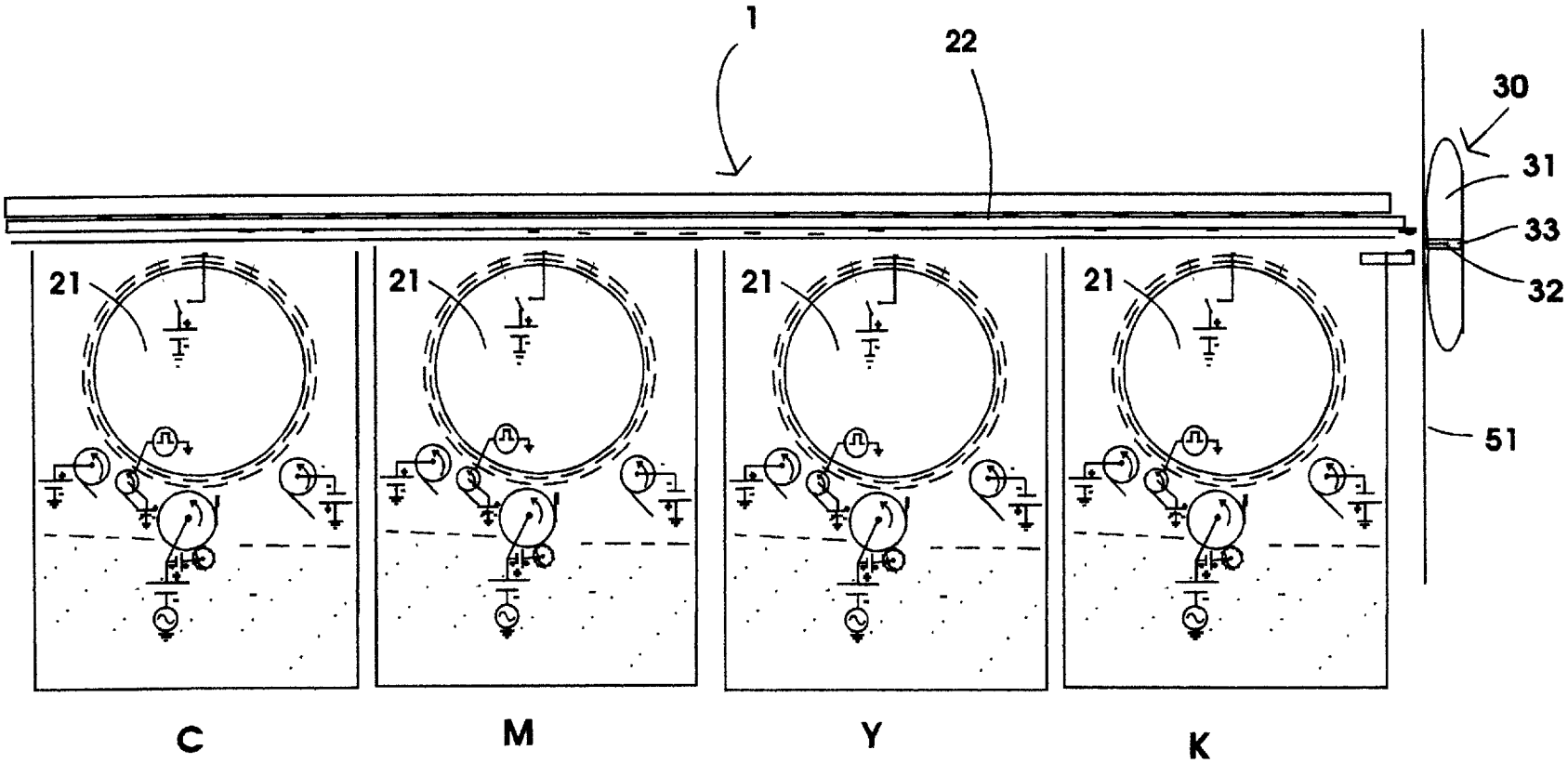

FIG. 15 is a schematic side view of an additive full-color process including CMYK supply conveyors sequentially transferring pixel packets to a single image transfer conveyor.

DETAILED DESCRIPTION OF THE INVENTION

FIG. 4*a* represents a side view of a monochrome XJ print engine, including a printhead 1, a toner processing/loading device 10, a paper shoe/focusing electrode assembly 30, a toner supply 40, a toner receiver assembly 46, a paper transport means 50, and a fuser assembly 55.

The printhead 1 is more fully described with reference to FIGS. 5, 6, 7. FIG. 5 is a schematic plan view of a conventional 4-phase CTC 2 connected to a 4-phase sine wave generator 70. FIG. 6 is an edge view of this conveyor showing odd conveyor electrodes ($\mathbf{60}_1$,$\mathbf{60}_3$) and even conveyor electrodes ($\mathbf{60}_2$, $\mathbf{60}_4$) on opposite sides of a substrate 67. In FIG. 7, the conveyor 2 is overlaid with parallel guide rails 5, orthogonal to the conveyor electrodes $\mathbf{60}_1$–$\mathbf{60}_4$. The guide rails 5 are positioned above the surface of the CTC 2 with suitable dielectric support strips, not shown in FIG. 7. The guide rails 5 are connected to a common bus 6 to facilitate the application of a repulsive voltage of the same polarity as the toner charge. For simplicity, the bus electrode 6 is shown off the downstream end of the conveyor in this illustration, whereas in practice it is placed in a layer under the conveyor where it does not obstruct toner flow. Examples of suitable positions are described in detail later. Throughout this description the polarity of all voltage supplies are selected assuming the toner polarity is positive.

FIG. 7 illustrates one arrangement of the ejector electrodes 4. One of the conveyor electrodes (e.g. $\mathbf{60}_4$-phantom lines indicate where it would have been) is replaced by electrically isolated ejector electrodes 4. Conductive leads 44 (indicated by phantom lines) on a lower circuit level connect the ejector electrodes 4 to electronic drivers mounted on the substrate of the printhead 1 along the side or lead edge of the conveyor, as in the area designated 45. It should be understood that the necessary connections between circuits on different levels are made in the usual manner that is well known in the art of multilayer circuit fabrication.

I have found from experience that toner momentum will continue the flow of toner on a 4-phase CTC even if one phase is electrically "floating" or connected to ground potential. I have also found that a dc repulsive voltage applied to one phase of the conveyor electrodes will cause toner to be deflected higher above the conveyor surface or cause it to leave the conveyor entirely. Therefore an ejector electrode can be inserted in the path of the toner flowing down a column to modulate the quantity of toner in a pixel packet without interfering with the continuous flow of toner down that column. The biased toner collection roll 14 in the toner receiver assembly 46 (in FIG. 4*a*), which is placed in close proximity to the ejector electrodes 4 in the printhead 1, collects any toner ejected by an ejector electrode. By means of pulse width modulated voltages applied to the ejector electrodes 4, as explained below, the pixel packets 8 moving from top to bottom in FIG. 7 are modulated from saturated (black) pixel packets 8 to unsaturated (gray) pixel packets 9. The level of gray produced by each packet is determined by the ejector pulse width applied to each ejector electrode 4. The pixel packets in row 9 are shown in different levels of gray, to represent the independent operation of each ejector electrode.

Voltage pulses applied to the ejector electrodes 4 for modulating the quantity of toner in a pixel packet can be provided by any suitable electronic drive system. One method is described in U.S. Pat. No. 5,193,011. This method has been used to print gray levels with the process known as DEP (ref. my publication entitled "Direct Electrostatic Printing (DEP)—A Simple Powder Marking Process", The Sixth Int. Cong. on Advances in Non-Impact Printing Technologies, Oct. 21–26, 1990).

The timing of ejector pulses applied to the ejector electrodes 4 in relation to the traveling sine wave on the CTC 2 is illustrated in FIG. 8. The phase angle $\theta$ for the traveling wave is $\theta=kx-2\pi ft$, where $k=2\pi/\lambda$, x is the distance along the conveyor in the process direction, f is the wave frequency, and t is time. The abscissa in FIG. 8 therefore scales with either distance along the conveyor at a fixed time (increasing from left to right), or time at a fixed position (increasing from right to left). The latter is useful to indicate the timing of the modulation pulse applied to an ejector electrode group. The sine wave propagates from left to right, and the ejector pulse 104 is applied during the concave upward ¼ cycle of the wave immediately behind the wave minimum. This is the portion of the wave that provides stable transport of toner. Its concave upward curvature provides stability of the moving toner cloud and keeps the toner confined to a small fraction of the wavelength. The center of the ejector pulse may be aligned by experimentation with the centroid of the toner mass in the pixel packet. Once aligned, increasing pulse width increases monotonically the amount of toner ejected from a pixel packet. The quantity of toner left in a pixel packet on the conveyor is thereby continuously varied from 0 to 100%.

Referring again to the side view of a monochrome XJ print engine in FIG. 4*a*, the toner processing/loading device 10 includes a donor roll 11, a charging/metering blade 12, and a preload roll 13, all within an open top housing 16. The toner receiver assembly 46 in the housing 16 includes a toner collection roll 14 with a scraper blade 15. A biased ac voltage 17 applied to the donor roll 11, now standard art in single component development, controls the loading (or development) of the traveling wave on the CTC 2. An additional offset voltage 19 is applied to the preload roll 13. Though not shown, a similar offset bias may be applied to the charging/metering blade 12 for improved control of the charging/metering process. A dc bias 18 (opposite in polarity to the toner charge) is applied to the toner collection roll 14. The toner collection roll 14 receives all toner removed from the printhead 1 by the ejector electrode 4. The scraper blade 15 causes the toner to be neutralized (via a self-generated corona) so it falls by gravity inside the housing 16. The dc bias 18, in conjunction with spacing between the toner collection roll 14 and ejector electrodes 4, is optimally adjusted to minimize the disturbance to pixel packets neighboring the ones under modulation.

An alternative means of facilitating the collection of toner ejected from printhead 1 with a minimum disturbance to neighboring pixel packets during modulation is to include a traveling wave receiver conveyor 123, shown in FIG. 4*c*. The receiver conveyor 123 is placed intermediate between the ejector electrodes 4 in printhead 1 and the collector roll 14. The traveling wave receiver conveyor 123, shown more clearly by the enlarged detail in FIG. 4*d*, is positioned and aligned so that the same phases oppose each other; i.e., phase 1 of one conveyor is opposite phase 1 of the other, phase 2 of one is opposite phase 2 of the other, etc. The receiver conveyor 123 may be further driven with the same four-phase generator that drives CTC 2 to assure proper synchronization of the two waves. For convenience of illustration, the conveyor 123 is shown in FIG. 4*d* connected to an equivalent four-phase generator 124. The receiver conveyor 123 may also include attraction electrodes (not shown) as fully described later in conjunction with an additive process included in this invention. The toner collected on the receiver conveyor 123 is transported into proximity with the collector roll 14 where it is transferred and neutralized for return to the toner sump.

FIG. 4*a* further includes the focusing system 30, shown enlarged in FIG. 4*b*, which receives toner flowing off the ends of the conveyor columns and forms toner jets focused onto the receiver sheet. The focusing system 30 includes a metallic paper shoe 31, comprised of a metallic blade electrode 32 embedded in insulating material 33, and the focusing electrodes 34 and 35. The insulating material 33 electrically isolates the blade electrode 32 from the rest of the paper shoe 31. Paper shoe 31 is positioned opposite the terminal end of the printhead 1 so that the electrode 32 is (vertically) midway between electrodes 34 and 35 and in the plane of the toner flow on conveyor 2. The focusing electrode 35 is rigidly attached to the edge of the substrate 3 of the printhead 1. The focusing electrode 34 is mounted on the housing 16. The electrodes 34 and 35 are symmetrically spaced equally above and below the toner flow on conveyor 2. The paper shoe 31 is rigidly mounted at its ends (beyond the edges of the paper) via brackets (not shown) on the housing 16. The spacing between the paper shoe and the focusing electrodes 34 and 35 is adjusted for optimal focusing while avoiding disturbance of toner accumulated on the receiver sheet 51. A typical value for this spacing is in the range of 100 to 300 microns, depending on the thickness of the receiver. A bias voltage 36 is applied to the electrodes 34 and 35 and adjusted to a low positive voltage to diminish the speed of toner passing between them. The bias voltages 38 and 37 are adjusted in relation to the bias voltage 36 to focus the toner onto the receiver sheet above the blade electrode 32. The bias voltage 38, connected to the blade electrode 32, is strongly attractive to the toner while the bias voltage 37 is relatively weakly attractive.

The image receiver 51, whether it is paper or a tacky adhesive, must pass through the focusing system 30 in good electrical contact with the paper shoe 31 to assure transfer of electric charge opposite in polarity to the toner to the back side of the receiver. The toner-imaged receiver, if it is paper, then passes through a fuser system 55 to fix the image. If the receiver has a tacky adhesive surface, it passes through laminating rollers to fix the image.

Still referring to FIG. 4*a*, the toner reservoir and supply system 40 includes a toner container 41, an agitator 43, and an auger 47. The auger 47 and agitator 43 are driven by an appropriate drive mechanism (not shown) and level sensor (not shown) to control the level L of toner 7 in the housing 16. Toner 7 in the supply 40 is kept fluid with the agitator 43 and delivered to the developer housing 16 by the auger 47.

The four-phase sine wave voltage generator 70 (FIG. 5) is connected via terminals 71, 72, 73, 74 to terminals 61, 62, 63, 64 respectively of the four-phase CTC 2 as indicated in FIG. 5. The voltage generator 70 energizes the electrodes $\mathbf{60}_1$, $\mathbf{60}_2$, $\mathbf{60}_3$, $\mathbf{60}_4$ in the proper sequence to move particles from top to bottom in FIG. 7, or from left to right in FIG. 4*a*.

Referring again to FIG. 4*a*, the collector roll 14, donor roll 11 and preload roll 13 are rotated at predetermined speeds to establish a print "ready" state prior to actual printing. The four-phase traveling wave generator 70 (FIG. 5) is also set for the required wave amplitude and frequency. The common terminal 78 of the four-phase generator may either be grounded or set to an appropriate level in relation to the dc bias of the excitation voltage 17 applied to the donor roll 11. Toner is charged and metered onto the donor roll 11 by the rotating preload roll 13 and the charging/metering blade 12. The force and positioning of this blade 12 are set to produce a predetermined charge and mass per unit area of toner on the donor roll. Excitation voltage 17 is then adjusted to load the CTC 2 to capacity—the maximum transportable in the surfing mode of TWTT. This toner then travels to the ejector electrodes 4, which are connected to the common bias 93 via switch 91. The bias 93 is made sufficient to eject all toner from the conveyor. At the same time, the toner collector bias voltage 18 applied to collector roll 14 is set to a value predetermined to capture any and all toner ejected from the conveyor. Scraper blade 15 is set to scrape off all toner from the collection roll 14. The scraped toner discharges via a self-generated corona and falls under gravity onto other toner in the toner sump of the housing 16. In this print "ready" state, the toner loaded onto the conveyor 2 is kept in motion until it is completely ejected, discharged and returned to the toner sump. The toner is never stopped or paused on the conveyor 2. This is necessary to keep the conveyor in a clean and serviceable state ready for printing.

Prior to actual printing, predetermined bias voltages are applied to the paper shoe 31 and focusing electrodes 32, 34 and 35. The proper levels of voltage applied to these electrodes can only be found by experimentation for the specific materials and structure being utilized. But the objective guiding the choice of voltage levels is to electrostatically form toner jets that focus the toner particles onto the receiver sheet 51 opposite the blade electrode 32. The field lines accessible to the toner particles leaving the conveyor must pass through the opening defined by electrodes 34 and 35 and end on the blade electrode 32. In addition, the speed of the particles landing on the receiver should be minimized to avoid excessive bounce. In general, this implies that the electrodes 34 and 35 must weakly repel the toner particles without interfering with their passage between them, while the electrodes 31 and 32 combined must attract the toner toward electrode 32 with the lowest possible energy.

With the above conditions set, printing is initiated by moving the image receiver 51 at the correct predetermined speed and connecting the ejector electrode 4 to a pulse supply 94 that supplies modulation voltages to the ejector electrodes in accordance with a program created to print the desired image. It should be appreciated that the printing process described here is inherently an analog process, but the printing of digital images is naturally accommodated via digitally controlled pulse width modulation. One example of a digitally controlled pulse supply 94 that is capable of printing continuous-tone images is disclosed in U.S. Pat. No. 5,193,011. Any pulse width modulation method that produces image density increments (say 128 or 256 of them) that are smaller than the threshold of visibility can produce the continuous-tone images achievable with this invention.

In the above process toner are removed from saturated pixel packets to print levels of gray. Thus it shall henceforth be referred to as a subtractive process. An additive embodiment of this invention is now described with reference to FIG. 9. In this embodiment, the toner handling system of FIG. 4*a* is replaced by a toner conditioning and transport system similar to that described in my U.S. Pat. No. 5,541,716. A significant feature of this embodiment is the incorporation of the delivery segment 103 of the toner supply conveyor 21 in FIG. 9 (identified as segment 3 in U.S. Pat. No. 5,541,716). The delivery segment 103 is designed for this application to transport toner in the normal surfing mode over an array of ejector electrodes 4, now incorporated in the delivery segment 103. Segment 103 optionally includes barrier electrodes (not shown) matching the barrier electrodes 5 on the image conveyor 22. The image conveyor 22 in FIG. 9 is identical in form to the CTC 2 in FIG. 4*a* except the previous ejector electrodes 4 now become the attraction electrodes 24 by virtue of how they are operated. Each attraction electrode 24 is connected to a dc biased pulse supply 92 whose voltage polarities are opposite to those of the dc biased pulse supply 94 connected to the ejector electrode 4. The delivery segment 103 of the supply conveyor 21 is positioned relative to the image conveyor 22 so that the ejector electrodes 4 are aligned directly opposite the attraction electrodes 24. Since there are no moving parts in these conveyors, accurate alignment can be achieved with the aide of alignment pins (not shown) during assembly. The supply conveyor 21 and the image conveyor 22 may be driven with the same four-phase generator shown in FIG. 5. This will assure the necessary synchronization and phase sequence of the traveling waves on the two conveyors. Toner is loaded onto the supply conveyor with the toner-loading device 27. Normally, wrong sign toner is rejected from the conveyor during the loading process with a properly biased toner-loading device 27, but any wrong sign toner that escapes rejection in this process can be subsequently removed by the wrong sign toner collector 25. The polarity of the bias supply 18 of the toner collector 25 is made positive (the same as the normal right sign toner) for this purpose. The spacing in the nip between the supply conveyor 21 and the image conveyor 22 is preset to a minimum value consistent with continuous toner flow through the nip between the conveyors with no toner transfer to the image transfer conveyor 22. While establishing this minimum spacing between the conveyors, the dc bias voltages of supplies 92 and 94 (with no pulse voltages active) may be set to low values (less than 10% of the wave amplitude). The operational objective is to set the dc bias voltages to be marginally less than the threshold for transfer of toner to the image transfer conveyor. Toner on the supply conveyor 21 that passes through the nip can be optionally removed from the supply conveyor via the right sign toner collector 26. Continuous steady state flow of toner on the supply conveyor is thereby established. Toner transfer from the supply conveyor 21 to the image transfer conveyor 22 is effected with pulses from the voltage supplies 92 and 94 operated synchronously in push-pull. The ratio of voltage amplitudes (or push/pull ratio) provided by the supplies 92 and 94 is chosen to minimize the perturbation of pixel packets neighboring the ones under modulation, as explained more fully later on. Pulse amplitudes and widths, approximately ¼ wave period, are made sufficient to effect nearly complete transfer of all toner, or enough to form saturated pixels on the image receiver. Modulation of the pulse width then modulates the quantity of toner transferred per pixel packet to form gray level pixels. All toner transferred to each column of the image conveyor finally flows off the end of the image conveyor into the focusing assembly 30 to form a toner jet focused onto the image receiver sheet 51. This final step of the additive process is identical to that described above for the subtractive process.

An important advantage of the above additive process over the subtractive process described earlier is its ability to produce better image quality in highlight areas of an image. This is because pixel packets containing small quantities of toner are more accurately controllable. Another significant advantage of the additive process is that it enables a simpler color printing process as disclosed later herein.

Another important part of this invention is a new multiplexing method, which I call "Phase Based Multiplexing". It is a process unique to TWTT. It arises because the traveling toner clouds occupy only a small fraction (less than ¼) of the wavelength. As a result, a wave period can be time shared, in mutually exclusive phase periods, to independently modulate pixel packets in contiguous columns with a common ejector electrode. The idea is best explained by illustration of the special case of 4×-multiplexing. Modifications of the printhead structure required for 4×-multiplexing is shown schematically in FIGS. 10*a* and 10*b*. FIG. 10*a* represents a schematic plan view of the printhead 1, or segment 103 of the supply conveyor 21 in FIG. 9. The procedure is applicable to both the additive and subtractive processes. The key feature of this structure is the staggered arrangement of ejector electrodes 4 grouped in contiguous sets of four, with successive electrodes within a group stepped ¼ wavelength (one conveyor electrode) down the conveyor in the process direction (from bottom to top in FIG. 10*a*). A staggered vertical Section A—A through the ejector electrodes is shown in FIG. 10*b*. Here all the ejector electrodes within a group are shown connected to a common bus 66 that passes below the CTC at a lower circuit level. The common bus 66 is electrically isolated from the CTC via the insulator layer 68. This circuit also includes a lead (not shown) that connects the ejector electrode group to one electronic driver in the pulse supply 94. The structure in FIG. 10*a* is further modified by inserting the ejector electrodes 4 between the conveyor electrodes. Additional space for the ejector electrodes can be created by narrowing, or notching, segments of the adjacent conveyor electrodes (not illustrated). The optimal sharing of space between the ejector electrodes and its neighboring conveyor electrodes for this segment can be determined by electric field analysis and experimentation. This type of construction is preferred over the substituted conveyor electrode segments indicated earlier because it limits the range of the ejector force field and minimizes the perturbation of contiguous pixel packets.

Figure 11B:
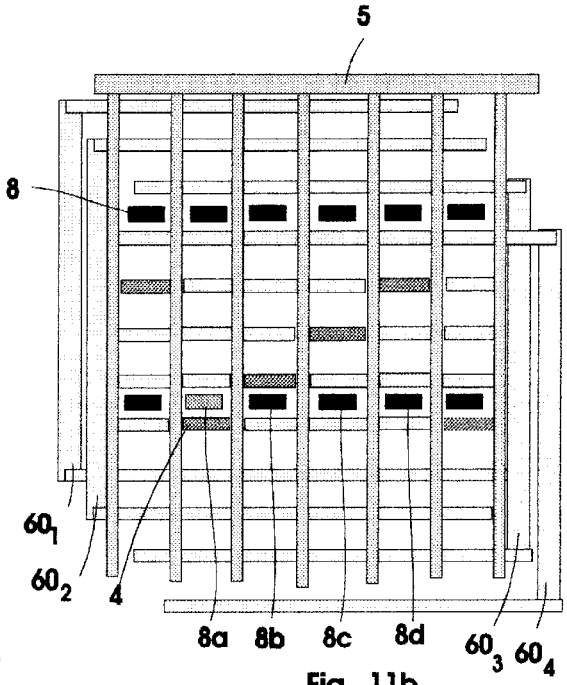
Figure 11C:
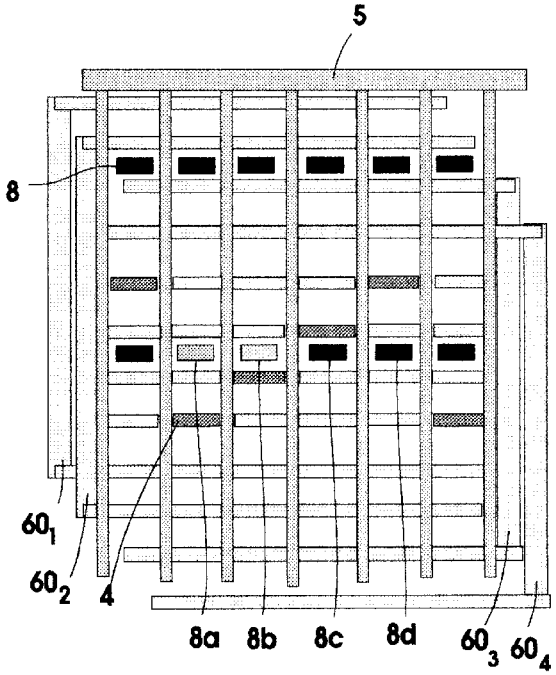
Figure 11D:
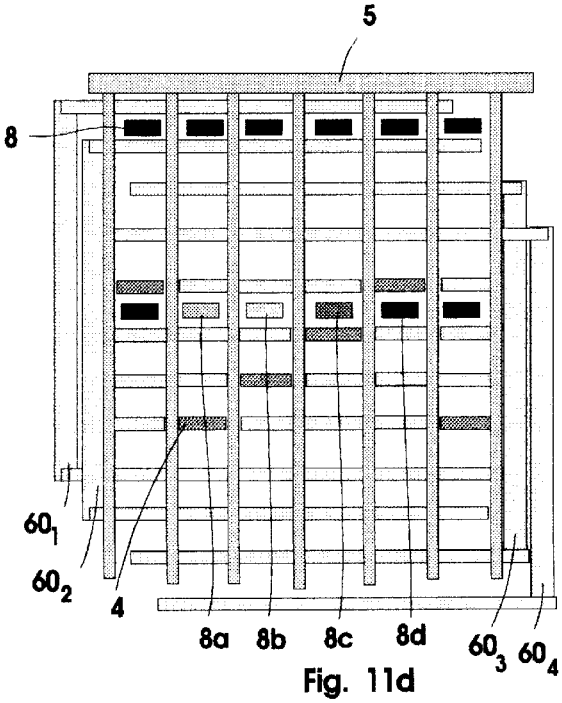

The multiplexing process is now explained with reference to FIGS. 11*a* through 11*d*. To simplify these figures, the ejector electrodes are again shown as segments taken from the conveyor electrodes, one segment being taken from each of the four conveyor phases. The sequence of FIGS. 11*a* through 11*d* is a schematic showing "snapshots" of the conveyor delayed ¼ wave period each. After each ¼ cycle the rows of saturated pixel packets 8 (shaded black) are shown advanced by ¼wavelength. The rows of pixel packets stay on a given wave, one full wavelength apart. FIG. 11*a* shows their initial position and FIG. 11*b* shows their position ¼ cycle later. Note that during this ¼ cycle, pixel packet 8*a* has crossed the first ejector electrode in a group while the remaining pixel packets in the same row have not yet reached an ejector electrode. A modulating voltage pulse applied to the ejector electrode group during the first ¼ cycle changes the quantity of toner in pixel packet 8*a*. This is indicated schematically in FIG. 11*b* by shading pixel packet 8*a* gray, symbolically representing the shade of gray desired when packet 8*a* is finally transferred to an image receiver. The same modulating pulse does not significantly affect the neighboring pixel packets because they are too far out of range of its force field. During the next ¼ cycle, pixel packet 8*b* advances to cross the ejector electrode in its column. During this time a second modulating pulse is applied to the same ejector group during which the quantity of toner in packet 8*b* is changed to produce the desired level of gray when packet 8*b* is finally transferred to the image receiver. This is indicated in FIG. 11*c*. Packets 8*c* and 8*d* are similarly modulated during the next two ¼ cycles, the first of which is indicated in FIG. 11*d*. Thereby, the modulation of toner flowing down the four contiguous conveyor columns controlled by a common ejector group is completed.

A series of voltage pulses applied to one ejector electrode group to modulate the toner flowing along four contiguous columns is shown schematically in FIG. 12. Recall that time increases to the left in FIG. 12. The modulation pulse 111 is applied to an ejector electrode group as the first pixel packet to arrive at the group (e.g., packet 8*a* in FIG. 11*a*) crosses the ejector electrode in its path. The concave upward part of the traveling wave following the potential minimum is approximately centered over the first ejector electrode at this time. The proper timing and pulse width for modulating the first pixel packet to arrive at an ejector electrode group is experimentally determined in advance by the procedure explained earlier. The second pixel packet to arrive at the ejector electrode is modulated with the pulse 112, applied to the same ejector group ¼ wave period (1/f) after pulse 111 is applied. Pulses 113 and 114 are delayed another ¼ period and ½ period respectively. In each case, the voltage pulses appear on all ejector electrodes in a group, but they act on only one pixel packet at a time.

It can now be appreciated that this novel multiplexing scheme is possible because the extension of the traveling toner cloud extends less than ¼ wavelength in the process direction. No toner is present on the conveyor for at least ¾ of a wavelength. Generalizing this idea, if toner were to cover only the fraction 1/n of a wave, then space and time would become similarly available for nX multiplexing. It should be emphasized that the significant feature of this "phase-based multiplexing" method is that it makes use of the empty space, or "dead time", on a traveling wave conveyor, thereby circumventing the sacrifice of process speed normally required for multiplexing. This is very important because it reduces the number of electronic drivers required which, in turn, simplifies the printhead construction and reduces the manufacturing cost with no loss of print speed. To make optimal use of this multiplexing scheme, the conveyor should be driven with an even number of sine wave voltages (typically used for a four-phase CTC). This provides the best approximation to a running sine wave, which minimizes the extension of the traveling toner clouds surfing down the conveyor. In general, the same principal can be applied for any type of "traveling wave", including the stepped trapezoidal well used for DPP. However, the toner in DPs would spread over a larger fraction of the wavelength (more than ⅓) which would limit the potential level of multiplexing to 2×.

It is now shown that phase-based multiplexing can be extended to arbitrarily high levels providing process speed is sacrificed for this extension in the usual manner. For example, every other toner cloud on the supply conveyor 21 in FIG. 9 can be removed from the supply conveyor by transferring them to the receiver assembly 28 with a periodic pulse 29 applied to the row ejector electrode 105. The linear toner clouds remaining on the conveyor on every other wave would proceed to the ejector electrodes 4 for modulation and transfer to the image conveyor 22. With alternate toner clouds removed from the transfer conveyor two contiguous groups of four ejector electrodes on the supply conveyor can be merged and connected to a common bus, increasing the level of multiplexing to 8×, as illustrated in FIG. 13. But since the toner flow on the conveyor to achieve this doubling of the multiplexing level is reduced by a factor of two, the process speed must also be reduced by the same factor, or ½ the speed for 4× multiplexing. Following the same procedure, the level of phase-based multiplexing can be similarly multiplied m-fold by keeping one toner cloud on the supply conveyor every $m^{th}$ wave. This would be accompanied by a factor of m speed reduction. In this manner process speed of a printer can be traded off for reduced cost. The optimal trade off is dependent on the application. The ejector voltage pulse 29 in FIG. 9 that is applied to the row ejector 105 to eject full linear toner clouds from a conveyor is a simple square wave pulse of amplitude and duration sufficient to cleanly eject a complete toner cloud. The pulse is applied to a sequence of m−1 waves, skipping the $m^{th}$ wave to allow one toner cloud to pass. It should be noted that the same procedure is applicable to both the additive and subtractive processes. For the latter, the row ejector electrode 105 and receiver assembly 28 would be included in the printhead 1 in FIG. 4*a*, ahead of the subtractive pixel packet modulation procedure.

The procedure of using isolated segments of conveyor electrode for ejector electrodes as conveniently illustrated in FIGS. 11*a* through 11*d* is disadvantaged in relation to the insertion technique illustrated in FIG. 10*a* for the following reason. The electric field around an ejector electrode may extend to the neighboring conveyor electrodes, if not sufficiently shielded by the receiver device (i.e., the receiver roll 14 in FIG. 4*a* or the receiver conveyor 123 in FIG. 4*d*). If the electric field lines from an ejector electrode end on the neighboring conveyor electrodes, they can perturb pixel packets contiguous to the one being modulated. For example, with reference to FIGS. 11*a* and 11*b*, pixel packet 8*b* crosses the conveyor electrode in front of the ejector electrode in its column while pixel packet 8*a* is being modulated. Electric field lines from the ejector pulse that modulates pixel packet 8*a* that reach this conveyor electrode can perturb (compress or distort) pixel packet 8*b*. An effective way to circumvent this effect, however, is to insert the ejector electrodes between the conveyor electrodes as illustrated in FIG. 10*a*. In this case, the modulating ejector pulse is applied when a pixel packet crosses a space between conveyor electrodes. The neighboring pixel packets are then in the next space between conveyor electrodes ¼ wave away where an intervening conveyor electrode shields it. Because of this shielding effect, insertion of the ejector electrodes between the conveyor electrodes is the preferred method of construction. It may be appreciated that an equivalent procedure would be to increase the number of conveyor phases in the CTC and leave a normal conveyor electrode between successive ejector electrodes within a group, limiting the range of the field lines from an ejector electrode to half the distance. This would provide 3× multiplexing with a 6-phase conveyor, 4× multiplexing with an 8-phase conveyor, etc. To keep the same wavelength, the width of the conveyor electrodes and spaces would have to be reduced accordingly. Because of this, such a procedure could prove more cumbersome and costly than the above insertion technique.

Still another procedure for limiting the range of the electric field from the ejector electrodes occurs naturally for the additive process described earlier with reference to FIG. 9. This is to adjust the ratio of voltage magnitudes applied to the attraction and ejector electrodes so that more field lines from the ejector electrode end on the attraction electrode instead of the adjacent conveyor electrodes. This same technique can be utilized for the subtractive process described with reference to FIG. 4*c* providing the receiver conveyor 123 is used to capture the ejected toner. Attraction electrodes can be incorporated into the receiver conveyor and operated in the same way as they are used to assist toner transfer to the image conveyor 22 from the supply conveyor 21. Toner collection in the subtractive process would then become equivalent (in reverse) to the transfer of toner to the image conveyor 22.

Referring again to FIG. 10*a*, with FIGS. 10*c* and 10*d*, different methods of constructing the barrier electrodes are now discussed. The barrier electrodes 5 in FIG. 10*a* are oriented vertically. An edge view of the printhead 1 (or supply conveyor) through Section B—B is shown in FIG. 10*c*. In this case, the barrier electrodes 5 are supported on insulator bars 69 and connected to a common bus 6 via feedthroughs 65. Ideally, the insulator bars 69 should be at least ⅛ wavelength high to provide a high wave force on the toner clouds near the barrier electrodes. Unfortunately, some difficulty may be encountered in the fabrication of insulator bars with a large height to width aspect ratio. Therefore, a more practical construction is to simply form the barrier electrodes 5 on top of the insulator layer that is normally overlaid on CTCs. In any case, the barrier electrodes 5 must be connected to the bus 6 to facilitate application of a dc bias repulsive to the toner. The bus 6 may be provided in a circuit level below the CTC and insulated from it by the insulator layer 68, as indicated in FIG. 10*c*. An alternative simplified construction is to isolate one of the conveyor electrodes, $\mathbf{60}_2$ in FIG. 10*c*, and use it as the common bus 6, as shown in FIG. 10*d*. Another novel approach to columnar toner flow on a conveyor is to use dielectric barriers alone (without the conductive electrodes 5) together with an electric field applied normal to the conveyor as disclosed in U.S. Pat. No. 5,541,716. Placing a field plate (or the shield electrode 41 in the 716 patent) in close proximity with the traveling wave conveyor will produce the required normal electric field.

The monochrome printing process described above can be extended to full four-color continuous-tone printers in different ways. The conventional method is to use four monochrome engines in tandem, each processing one of the standard color components—cyan, magenta, yellow and black (CMYK). This is illustrated schematically in FIG. 14 for the subtractive process illustrated in FIG. 4*a*. The process speed of the color printer would be the same as the monochrome speed. A more novel full color process unique to TWTT makes use of the additive process in the manner illustrated in FIG. 15. Here, the image conveyor 22 in FIG. 9 is extended in length to accommodate four supply conveyors 21 in tandem, individually adding CMYK toners to the same image transfer conveyor. The advantage of this process is that it synthesizes the color components in perfect registration using only one image transfer conveyor. The apparatus sketched in FIG. 15 can be operated in a variety of ways. Modulated pixel packets of all the color components can be injected into common pixel packets on the transfer conveyor. This will preserve the speed of a monochrome process for color printer applications. Alternatively, two pairs of color toners can be added to alternate waves, or rows of pixel packets. The process speed in this case would be ½ the monochrome speed. Similarly, each color toner can be added to every fourth pixel packet with a process speed ¼ the monochrome speed. Building on these examples, a wide variety of opportunities for mixing and blending color toners for novel color printing applications become evident.

Because of the simple means of handling color toners and the virtually unlimited multiplexing level available, the cost of XJ color printers can be made very low, virtually independent of the voltage level required for the electronic drivers. It is anticipated that the cost of XJ printers can be made competitive with liquid ink jet printers, while offering much higher print quality and print speed. Indeed, the continuous-tone capability and perfect registration of the separated color images are key features of this technology that enable achievement of the ultimate (photographic like) print quality. Control of image granularity is the final issue to be addressed.

Granularity is a well-established measure of image noise, or "graininess". It is manifest as density fluctuations in an image and measured with a densitometer. The accepted unit of granularity is "equivalent particle size", which is the diameter of optically opaque particles that would produce the same measured granularity. It has also been well-established that the graininess of an image (viewed without magnification) is below the threshold of visibility if the equivalent particle size is sufficiently small—less than approximately four microns in diameter. To print pictorial images of photographic quality, toner satisfying this effective particle size criterion can be used with the XJ process. The XJ process will then transcend all other known dry powder printing technologies in the print quality of the color images produced.

Toner satisfying the above "equivalent particle size" criterion for reducing the granularity of an image below the threshold of visibility can be achieved in different ways. One way is to use opaque toner particles of small physical size (less than four microns in diameter). Another way is to limit the quantity of colorant (dye or pigment) in toner particles so the so the measured granularity is an equivalent particle size below the threshold of visibility. The quantity of colorant in a toner particle would be approximately the same or less than that in opaque particles. Clear or transparent material can be mixed with the colorant to make toner particles of the same equivalent particle size but significantly larger physical size. The advantage of doing this is that physically large toner particles, can provide greater process latitude through greater flowability, less adhesion, lower tribo, etc. It is therefore preferred that such toner be utilized in XJ printer applications.

To enhance process latitude commercial xerographic toner is at least seven microns in diameter. Unfortunately, such toner is also opaque. As a result, image granularity has limited the utility of xerographic based (dry powder) technology in printer applications. The traditional way of suppressing granularity, as well as other types of image noise, in extant printers it to utilize a half-tone technique. Indeed, very sophisticated half-tone techniques have been developed for this purpose. It should be evident that such half-tone techniques can also be applied to the presently invented XJ process. The deposition of one row of pixel packets transported by one wave is equivalent to a scan (or raster) line in conventional printing systems like scanned laser printers. The size of a pixel in the process direction is controlled by choice of process speed and wave frequency. The intensity, or level density of one pixel is arbitrarily divisible into discrete levels (say 8, 16 or 32) using an appropriately limited set of modulating pulse widths. The combination of size and level for the elemental pixels provides virtually unlimited choices for forming half-tone cells. The XJ process is therefore readily adapted to any desired half-tone procedure. A possible advantage of this is that prints with good acceptable quality can be made using conventional commercial toners. Print quality comparable to that achieved with the best laser printers which utilize the half-tone technique can be achieved. The ultimate mode of operating of XJ printers, however, is the continuous-tone mode using toner materials having an equivalent particle size below the threshold of visibility. The XJ technology then has the potential to emulate the dye-diffusion printing technology, but at a dramatically lower cost and increased speed.

Images fused on paper are suitable for typical non-impact printing applications. Laminated tape images are suitable for photographic, labeling, security badge, or other applications.

I claim:

1. An apparatus for delivering electrostatically charged toner particles to an image receiving member, including:

a traveling electrostatic wave toner conveyor overlaid with longitudinal barriers, said longitudinal barriers dividing said toner conveyor into parallel columns and the combination of said traveling electrostatic wave toner conveyor and said longitudinal barriers forming isolated potential wells to receive pixel packets of toner therein, wherein said traveling electrostatic wave toner conveyor conveys said pixel packets, in an aerosol state, to said image receiving member;

an ejector electrode in registry with each of said columns, said ejector electrodes responsive to modulated voltage applied thereto, to modulate the quantity of toner in said pixel packets in said columns; and focusing means to transfer said pixel packets from said toner conveyor to said image receiving member.

2. Apparatus as defined in claim 1, wherein said barriers are barrier electrodes, and further including a repulsive dc bias applied to said barrier electrodes to confine toner within said columns.

3. Apparatus as defined in claim 1, wherein said barriers are dielectric, and further including a field plate over said barriers to compress the elevation of toner in said columns.

4. Apparatus as defined in claim 1, further including a traveling wave receiver conveyor for collecting toner ejected from said toner conveyor by said ejector electrodes.

5. Apparatus as defined in claim 4, further including attraction electrodes in said receiver conveyor in registry with said ejector electrodes in said toner conveyor.

6. Apparatus as defined in claim 1, wherein said barriers are separated by a pixel width.

7. Apparatus as defined in claim 1, wherein said toner conveyor and said ejector electrodes are disposed on a single rigid flat substrate with integrated driver electronics.

8. Apparatus as defined in claim 1, wherein said toner conveyor operates at a wavelength greater than 60 microns.

9. Apparatus as defined in claim 1, wherein said toner conveyor includes an even number of conveyor electrodes to which mutually phase shifted sine wave voltages are applied.

10. Apparatus as defined in claim 1, with three additional such apparatuses, one of the combined four apparatuses for use with each of CMYK toners, to supply pixel packets of CMYK toners in tandem to said image receiving member.

11. Apparatus as defined in claim 10, wherein said CMYK toners are of equivalent particle size small enough to reduce granularity of continuous tone images below the threshold of visibility.

12. Apparatus as defined in claim 9, further including:

n groups of N said ejector electrodes, said N electrodes in each group displaced relative to one another in the process direction of said columns in increments of one-Nth wavelength of said toner conveyor; and pulse means for delivering ejector pulses sequentially to said N ejector electrodes in each group through a bus electrode common to said group, said pulses separated by one-Nth wave period of said toner conveyor.

13. Apparatus as defined in claim 12, wherein a toner cloud is entrained in every $M^{th}$ traveling wave on said toner conveyor;

M contiguous groups of N ejector electrodes each are merged by connecting them to a common bus to form n/M sets of 4M ejector electrodes each; and pulse means for delivering 4M ejector pulses sequentially to said 4M ejector electrodes connected to said common bus, said pulses separated by one quarter wave period of said traveling wave of said toner conveyor.

14. Apparatus for delivering electrostatically charged toner particles to an image receiving member, including:

a traveling electrostatic wave toner conveyor overlaid with longitudinal barriers dividing said toner conveyor into parallel columns and the combination of said traveling electrostatic wave toner conveyor and said longitudinal barriers forming isolated potential wells to receive modulated pixel packets of toner therein, wherein said traveling electrostatic wave toner conveyor conveys said pixel packets to said image receiving member;

a traveling electrostatic wave toner supply conveyor to supply said modulated pixel packets to said toner conveyor;

an ejector electrode on said supply conveyor in registry with each of said columns on said toner conveyor to eject toner from said supply conveyor to said toner conveyor, said ejector electrodes responsive to modulated voltage applied thereto to modulate the quantity of toner in said pixel packets; and focusing means to transfer said pixel packets from said toner conveyor to said image receiving member.

15. Apparatus as defined in claim 14, wherein said barriers are barrier electrodes, and further including a repulsive dc bias applied to said barrier electrodes to confine toner within said columns.

16. Apparatus as defined in claim 14, wherein said barriers are separated by a pixel width.

17. Apparatus as defined in claim 14, wherein said supply conveyor operates at a wavelength greater than 60 microns.

18. Apparatus as defined in claim 14, further including:

n groups of N said ejector electrodes, said N electrodes in each group displaced relative to one another in the process direction of said columns in increments of one-Nth wavelength of said supply conveyor; and pulse means for delivering ejector pulses sequentially to said N ejector electrodes in each group through a bus electrode common to said group, said pulses separated by one-Nth wave period of said supply conveyor.

19. Apparatus as defined in claim 18, wherein a toner cloud is entrained in every $M^{th}$ traveling wave on said toner supply conveyor;

M contiguous said groups of N ejector electrodes each are merged by connecting them to a common bus to form n/M sets of 4M ejector electrodes each; and pulse means for delivering 4M ejector pulses sequentially to said 4M ejector electrodes connected to said common bus, said pulses separated by one quarter wave period of said traveling wave of said toner conveyor.

20. Apparatus as defined in claim 14, further including:

an attraction electrode on said toner conveyor in registry with each of said ejector electrodes on said supply conveyor to attract toner from said supply conveyor to said toner conveyor;

said attraction electrodes responsive to modulated voltage applied thereto to assist modulation of the quantity of toner in said pixel packets on said toner conveyor, said voltage applied to said attraction electrodes being synchronous with, and opposite in polarity to, the modulated voltage applied to said ejector electrodes.

21. Apparatus as defined in claim 14, including four said supply conveyors in tandem, one for each of CMYK toners, to supply pixel packets of CMYK toners to said toner conveyor.

22. Apparatus as defined in claim 21, wherein said CMYK toners are of equivalent particle size small enough to reduce granularity of continuous tone images below the threshold of visibility.

23. Apparatus for delivering electrostatically charged toner particles to an image receiving member, including:

a traveling electrostatic wave toner conveyor overlaid with longitudinal barriers dividing said toner conveyor into parallel columns and the combination of said traveling electrostatic wave toner conveyor and said longitudinal barriers forming isolated potential wells to receive pixel packets of toner therein, wherein said traveling electrostatic wave toner conveyor conveys said pixel packets to said image receiving member;

an ejector electrode in registry with each of said columns, said ejector electrodes responsive to modulated voltage applied thereto to modulate the quantity of toner in said pixel packets in said columns:

said ejector electrodes disposed in n groups of N electrodes across the width of said toner conveyor, said N electrodes in each group displaced relative to one another in the process direction of said columns in increments of one-Nth wavelength of said toner conveyor; and pulse means for delivering ejector pulses sequentially to said N electrodes in each group through a bus electrode common to said group, said pulses separated by one-Nth wave period of said toner conveyor, where N is an integer greater than 1 and less than 7.

24. Apparatus for delivering electrostatically charged toner particles to an image receiving member, including:

a traveling electrostatic wave toner conveyor overlaid with longitudinal barriers dividing said toner conveyor into parallel columns and the combination of said traveling electrostatic wave toner conveyor and said longitudinal barriers forming isolated potential wells to receive modulated pixel packets of toner therein, wherein said traveling electrostatic wave toner conveyor conveys said pixel packets to said image receiving member;

a traveling electrostatic wave toner supply conveyor to supply said pixel packets to said toner conveyor;

an ejector electrode on said supply conveyor in registry with each of said columns on said toner conveyor to eject toner from said supply conveyor to said toner conveyor, said ejector electrodes responsive to modulated voltage applied thereto to modulate the quantity of toner in said pixel packets on said toner conveyor;

said ejector electrodes disposed in n groups of N electrodes across the width of said supply conveyor, said N electrodes in each group displaced relative to one another in the process direction of said columns in increments of one-Nth wavelength of said toner conveyor; and pulse means for delivering ejector pulses sequentially to said N electrodes in each group through a bus electrode common to said group, said pulses separated by one-Nth wave period of said toner conveyor, where N is an integer greater than 1 and less than 7.

25. A method of delivering electrostatically charged toner particles to an image receiving member, including the following steps:

transporting linear clouds of said charged toner particles along a traveling electrostatic wave toner conveyor to said image receiving member by means of a plurality of mutually phase-shifted sine wave voltages applied to said toner conveyor;

segmenting said toner clouds into parallel columns of pixel packets with a plurality of parallel barrier electrodes associated with the toner conveyor;

modulating toner quantities in said pixel packets; and focusing said pixel packets on said image receiving member to form continuous tone images.

26. A method as defined in claim 25, in which said plurality is an even number.

27. A method as defined in claim 25, further including the following step:

loading toner onto said toner conveyor from a toner supply conveyor.

28. A method as defined in claim 25, wherein half the length of said electrostatic wave on said toner conveyor is at least twice the diameter of said toner particles.

29. A method as defined in claim 25 performed sequentially with CMYK toners for printing continuous tone.

30. The method of claim 25, said modulating step further defined as:

separately modulating a plurality of pixel packets on a common traveling wave by sequentially applying voltage pulses to said plurality of pixel packets.

31. The method of claim 25, said modulating step further defined as:

separately modulating contiguous pixel packets on a common traveling wave via time shared use of a single pulsed voltage supply in mutually exclusive phase intervals.

* * * * *